US009593879B2

(12) United States Patent
Burke et al.

(10) Patent No.: US 9,593,879 B2
(45) Date of Patent: Mar. 14, 2017

(54) U-SHAPED TUCK SHELF

(71) Applicant: Whirlpool Corporation, Benton Harbor, MI (US)

(72) Inventors: Julia B. Burke, Chicago, IL (US); Daniel Chow, St. Joseph, MI (US); Juan F. Flores, Stevensville, MI (US); Todd Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/659,817

(22) Filed: Mar. 17, 2015

(65) Prior Publication Data

US 2016/0273828 A1 Sep. 22, 2016

(51) Int. Cl.

| | |
|---|---|
| ***A47F 5/00*** | (2006.01) |
| ***F25D 25/02*** | (2006.01) |
| ***A47B 96/02*** | (2006.01) |
| ***F25D 23/00*** | (2006.01) |
| ***F25D 23/06*** | (2006.01) |

(52) U.S. Cl.

CPC ..... *F25D 25/02* (2013.01); *A47B 96/025* (2013.01); *F25D 23/00* (2013.01); *F25D 23/067* (2013.01); *F25D 2325/021* (2013.01); *F25D 2331/803* (2013.01); *F25D 2500/02* (2013.01)

(58) Field of Classification Search

CPC ... A47B 45/00; A47B 57/583; A47B 87/0246; A47B 96/025; F25D 23/00; F25D 23/067; F25D 25/02; A47F 5/10; A47F 5/16; A47F 5/0081

USPC ..... 312/401, 408, 351; 211/153, 186; 108/65, 66, 90

See application file for complete search history.

(56) References Cited

U.S. PATENT DOCUMENTS

| | | | | |
|---|---|---|---|---|
| 774,117 | A * | 11/1904 | Tandy | A47B 67/02 211/47 |
| 1,997,432 | A | 4/1935 | Replogle | |
| 5,415,472 | A * | 5/1995 | Brise | A47B 45/00 211/153 |
| 5,735,589 | A | 4/1998 | Herrmann et al. | |

(Continued)

FOREIGN PATENT DOCUMENTS

| | | |
|---|---|---|
| CN | 201779952 U | 3/2011 |
| CN | 102395849 A | 3/2012 |

(Continued)

OTHER PUBLICATIONS

European Patent Application No. 16160961.5 filed Mar. 17, 2016, Applicant: Whirlpool Europe Srl, Extended European Search Report, mail date: Jul. 8, 2016, re: same.

*Primary Examiner* — James O Hansen

(57) ABSTRACT

A refrigerator cabinet including a plurality of U-shaped shelves is provided. Each of the plurality of U-shaped shelves includes left, right and back portions located in a horizontal fashion with one shelf above another. A mounting structure is provided for supporting the U-shaped shelves; and a removable shelf is located within one or more of the U-shaped shelves. In addition, a tuck shelf is mounted in at least one of the plurality of U-shaped shelves, the tuck shelf being disposed either against at least a back portion of the at least one U-shaped shelf or between the removable shelf and a portion of the at least one U-shaped shelf that is closest to a user of the refrigerator.

11 Claims, 44 Drawing Sheets

(56) References Cited

U.S. PATENT DOCUMENTS

| | | | | |
|---|---|---|---|---|
| 7,878,344 | B2 | 2/2011 | Martin et al. | |
| 8,777,341 | B2 | 7/2014 | Amaral et al. | |
| 2003/0020387 | A1 | 1/2003 | Wing et al. | |
| 2010/0102693 | A1* | 4/2010 | Driver | A47B 95/043 312/408 |
| 2011/0001415 | A1* | 1/2011 | Park | F25D 25/02 312/408 |
| 2011/0115356 | A1 | 5/2011 | Nash et al. | |
| 2012/0091084 | A1 | 4/2012 | Amaral et al. | |
| 2012/0223038 | A1* | 9/2012 | Bean | A47B 96/021 211/90.01 |
| 2013/0020922 | A1 | 1/2013 | Jang | |
| 2015/0068999 | A1 | 3/2015 | Dart et al. | |

FOREIGN PATENT DOCUMENTS

| | | | | |
|---|---|---|---|---|
| CN | 102494496 | A | | 6/2012 |
| CN | 102135363 | B | | 12/2012 |
| CN | 102829604 | A | | 12/2012 |
| CN | 102889744 | A | | 1/2013 |
| JP | 2002090054 | A | | 3/2002 |
| KR | 10431346 | B1 | | 5/2004 |
| KR | 10756887 | B1 | | 9/2007 |
| WO | 2008015180 | A2 | | 2/2008 |
| WO | WO 2008-015180 | | * | 2/2008 |
| WO | 2009155679 | A2 | | 12/2009 |
| WO | WO 2009-155679 | | * | 12/2009 |

* cited by examiner

U-SHAPED TUCK SHELF

CROSS-REFERENCE TO RELATED APPLICATIONS

The present application is related to, and hereby incorporates by reference, the entire disclosures of the following applications for United States Patents: U.S. patent application Ser. No. 29/520,674 entitled "SHELVING ARRANGEMENT FOR A REFRIGERATOR," filed on even date herewith; U.S. patent application Ser. No. 29/520,677 entitled "SHELVING ARRANGEMENT FOR A REFRIGERATOR," filed on even date herewith; and U.S. patent application Ser. No. 29/520,679 entitled "SHELVING ARRANGEMENT FOR A REFRIGERATOR," filed on even date herewith.

FIELD OF THE DISCLOSURE

This application relates to a panoramic cabinet for refrigeration. In particular, the present disclosure relates to a U-shaped tuck shelf for a refrigerator that gives the inside of a refrigerator the look of a pantry, with panoramic U-shaped cabinet shelving and tuck shelves that slide backwards to slide underneath a removable shelf or the U-shaped shelf. This provides the user with the ability to configure the refrigerator with shelves extending across the width or substantially all the width and allows a user of a refrigerator to "tuck" the tuck shelf under a removable shelf or under the U-shaped shelf, which makes it more convenient for a user to reach items in the back or at the sides or store taller and/or larger items in the refrigerator without adjusting the height of the shelves. The U-shaped shelf allows for storage of more comestible as well and generally provides a more pleasing view of the inside of a refrigerator.

SUMMARY

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

According to an aspect of the disclosed invention, a U-shaped shelf for a refrigerator cabinet is provided. The U-shaped shelf includes a left side portion that extends at least substantially along the left side of a refrigerator cabinet from the back of the cabinet towards the front of the cabinet which faces a user. A right side portion extends at least substantially along the right side of the refrigerator cabinet from the back of the cabinet towards the front of the cabinet which faces a user. A back portion extends between the left and right side portions, wherein the left, right and back portions form a U-shaped shelf within the refrigerator cabinet.

According to another aspect of the disclosed invention, a refrigerator cabinet including a plurality of U-shaped shelves is provided. The refrigerator cabinet having a plurality of U-shaped shelves includes a plurality of U-shaped shelves having left, right and back portions located in a horizontal fashion with one shelf above another. A mounting structure is provided for supporting the U-shaped shelves. In addition, a removable shelf is provided within one or more of the U-shaped shelves, and a tuck shelf is mounted in at least one U-shaped shelf. The tuck shelf is disposed either against at least a back portion of the at least one U-shaped shelf or between the removable shelf and a portion of the at least one U-shaped shelf that is closest to a user of the refrigerator.

According to another aspect of the invention, a refrigerator cabinet including a plurality of shelves is provided. At least one of the pluralities of shelves has a U-shape. At least one U-shaped shelf having left, right and back portions is located in a horizontal fashion. In addition, a mounting structure for supporting the U-shaped shelves is further provided.

BRIEF DESCRIPTION OF THE DRAWINGS

FIG. 64 shows an embodiment of a refrigerator with a full shelf and two tuck shelves that are offset from the center of the shelf they are in.

DETAILED DESCRIPTION OF THE PRESENT DISCLOSURE

Before the subject invention is described further, it is to be understood that the invention is not limited to the particular present disclosure described below, as many variations of the present disclosure may be made and still fall within the scope of the appended claims. It is also to be understood that the terminology employed is for the purpose of describing present disclosure, and is not intended to be limiting in any manner.

In this specification and the appended claims, the singular forms "a," "an" and "the" include plural reference unless the context clearly dictates otherwise. The present disclosure is generally directed toward a refrigerator incorporating a U-shaped or L-shaped tuck shelf in a user selectable configuration and present a pantry-like look at the interior of the appliance.

Figure 1:
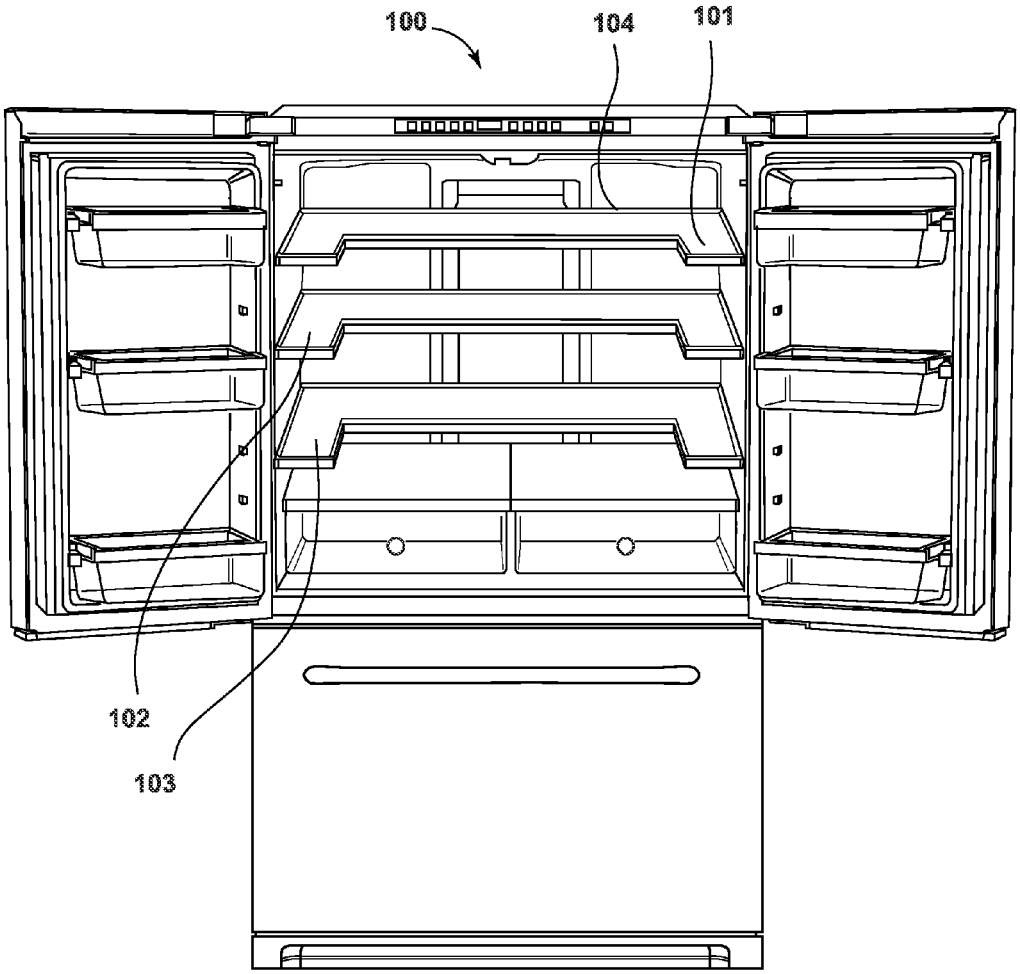
FIG. 1 is a front perspective view of a French door bottom mount (FDBM) refrigerator with the refrigerator compartment doors open and bottom freezer compartment door closed.

For purposes of description herein, The terms "upper," "lower," "right," "left," "rear," "front," "vertical," "horizontal," "top," "bottom," "left," "right" and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply present disclosure of the inventive concepts defined in the appended claims. Hence, specific dimensions and other physical characteristics relating to the present disclosure disclosed herein are not to be considered as limiting, unless the claims expressly state otherwise.

Figure 2:
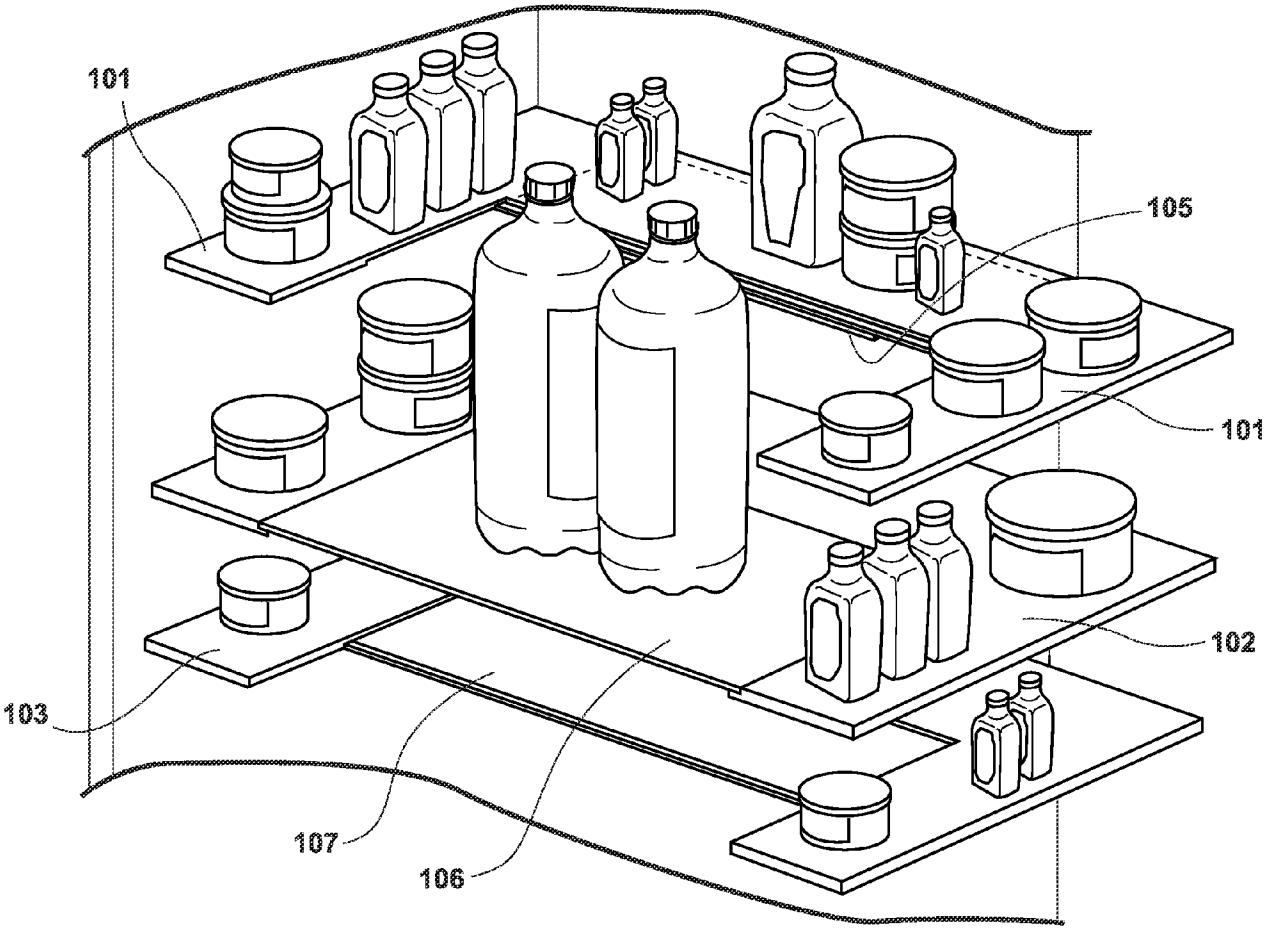
FIG. 2 is a perspective view of the U-shaped shelves of the FDBM refrigerator of FIG. 1, along with food items mounted on the shelves within the refrigerator cabinet.

FIG. 1 is a front view a French door refrigerator with a bottom mount freezer (FDBM) with the refrigerator doors open. In the refrigerator cabinet shown there are three U-shaped shelves, respectively labeled 101, 102 and 103. Also shown on each of the shelves is a raised area 104 around the perimeter of each of the shelves 101-103. When utilized, the raised area 104 prevents spills from coming down from edges of the sides, back or inside of the refrigerator cabinet. In addition, not shown in FIG. 1, are specific ways of mounting the shelves within the refrigerator. The shelves could be mounted on ribs or guides which extend outwardly from the visible surface of the refrigerator cabinet. Alternatively, there could be recesses in the cabinet with projections on the shelves sliding into the recesses, or the shelves could be mounted on slidable brackets However, the exemplary embodiments are not limited thereto and other known methods of attaching the shelves to the inside of the refrigerator may be used, as would be understood by one of ordinary skill in the art. It may be possible to mount the shelves of the present disclosure to both sides and the rear wall and not utilize a center mounting bracket/system as is often used currently to support shelves that only extend across a maximum of one-half the width of the refrigerator compartment. Instead, the shelves of the present disclosure typically extend across the entire width or substantially the entire width of the refrigerator compartment FIG. 2 is a perspective view of the inside of the refrigerator of FIG. 1. While one or a plurality of tuck shelves may be employed, FIG. 2 shows three U-shaped shelves, each of which has a removable shelf or a tuck shelf. As shown in FIG. 2, first shelf 101, second shelf 102 and third shelf 103 shown with food on each of the shelves. However, this figure does not show the raised edges around the edges of the U-shaped shelves. The raised edges, which may be provided to prevent spills, are optional. In addition, a trim piece or trim pieces may be provided at the edges of the removable shelves or tuck shelves of the U-shaped shelves. Moreover, the top shelf 101 shows a tuck shelf which may be slid in a horizontal direction into position under the back of the U-shaped shelf 101. This slidable tuck shelf is labeled 105. In addition, in FIG. 2, in the center of the middle U-shaped shelf 102 is a removable shelf which is a glass shelf, but may be made of a plastic, wood, or wood-look material. The removable shelf 106, as shown, fills the entire U-shape of the U-shaped shelf 102, but is not limited thereto, as the removable shelf may not fill the entire opening of the U-shaped shelf 102. This shelf can hold large items, for example, bottles of large liquids such as large bottles of soda or wine, etc., and these large items can be vertically oriented and can extend into the area of the U-shape of U-shaped shelf 101. This occurs when tuck shelf 105 is tucked under the back wall of U-shape shelf 101. This can be seen by the dotted line on shelf 101 in FIG. 2 above it because the shelf insert 105 is tucked in under the back of the U-shape shelf as shown by the dotted line in the back of shelf 101. In addition, at the bottom shelf 103, there is a removable shelf 107 which partially fills the U-shape of U-shaped shelf 103. The removable shelf 107 may be raised for removal or may be slidable outwardly for removal from U-shaped shelf 103. As an alternative, this shelf may be a tuck shelf which is slidable under shelf 103 in a horizontal direction. The exemplary embodiment of FIG. 2 shows the ease in which a user may reach items on the back of the top shelf 101 of the refrigerator cabinet. The tuck shelf does not, when extended typically result in a surface in the same plane as the remainder of the U-shaped or L-shaped (in certain aspects) portion of the shelf. Instead, it is typically in a parallel plane immediately below the plane of the U-shaped or L-shaped portions of the shelf and residing in a separate groove or slots on the sides of the shelves form the rearward portion the tuck shelf is under when in the retracted position.

Figure 3:
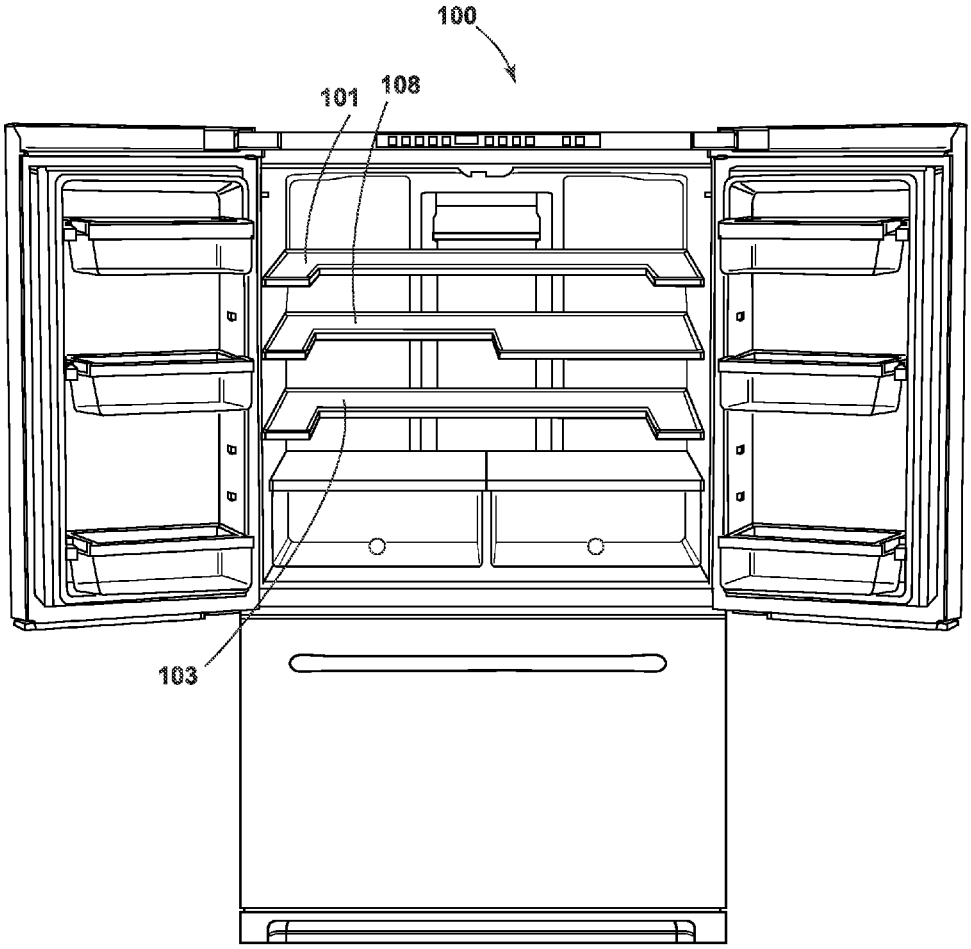
FIG. 3 is a front perspective view of a FDBM refrigerator.

FIG. 3 is a front view of a French door refrigerator having a bottom mount freezer (FDBM) showing the French doors in an open position. In this exemplary embodiment, three shelves as shown in the previous FIG. 2. The difference between this figure and FIG. 2 is that is in FIG. 3, the middle U-shaped shelf is not centered as is the opening in the U-shape of the other two U-shaped shelves 101 and 103. Rather the opening in U-shaped shelf 108 is shifted over to one side. This recess could either have a removable shelf, a tuck shelf or no shelves at all. In addition, any shelf could be manufactured of glass, plastic wood, or of a wood-look. In addition, as shown in FIG. 1, an optionally raised edge is shown around the outer perimeter of each of the three shelves to prevent any kind of liquid from spilling off of the shelf.

Figure 4:
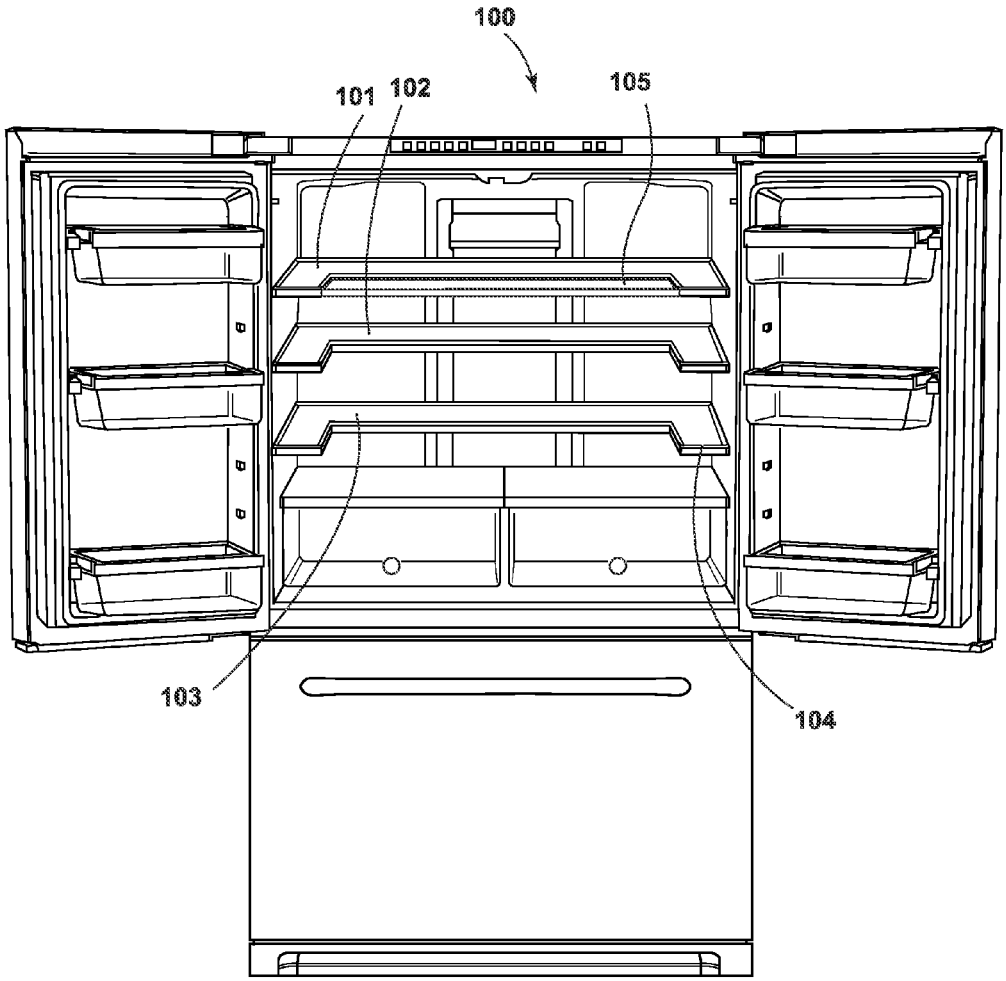
FIG. 4 is front perspective view of a FDBM refrigerator.

FIG. 4 is a front view of a French door refrigerator with a bottom mount freezer (FDBM) with the doors open and showing three U-shaped shelves that are the same as each of the shelves 101-103 of FIG. 1. In the exemplary embodiment of FIG. 4, each of the shelves also has a raised edge around the perimeter of each U-shaped shelf to prevent spills from dripping off of the edges of the U-shaped shelves of the refrigerator cabinet. In addition, the top-most shelf 101 has a tuck shelf 105 therein which partially fills the opening of the U-shaped shelf 101. This tuck shelf 105 slides under the back of U-shape shelf 101 in a horizontal manner. Further details of how the shelf slides into place at the back of the U-shaped shelf are described in later figures.

Figure 5:
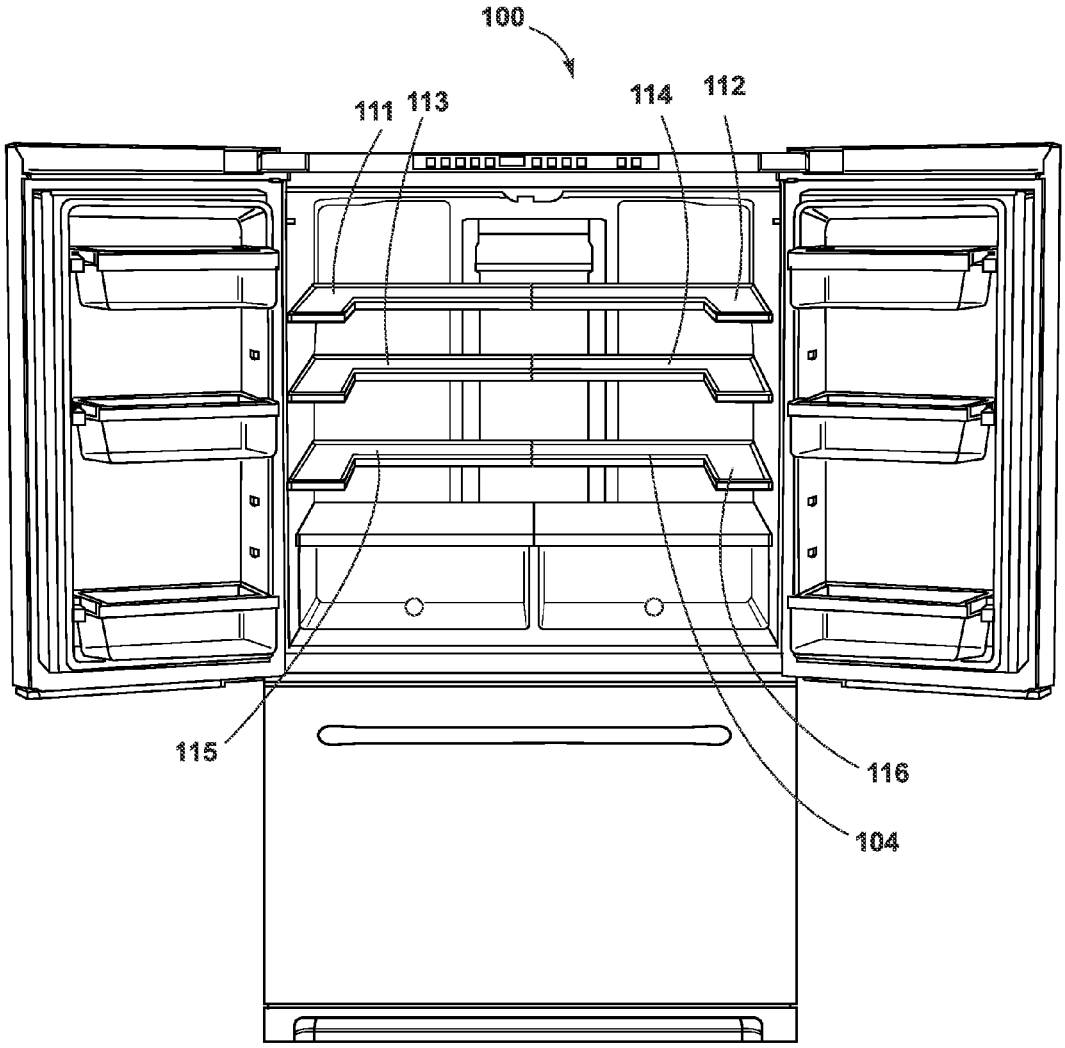
FIG. 5 is a front perspective view of a FDBM refrigerator.

FIG. 5 is a frontal view of a French door refrigerator with a bottom mount freezer (FDBM) with the doors open. This figure is also similar to FIG. 1 with the exception that each of the U-shaped shelves are made up of two pieces which are either joined or simply abutting each other at the center of U-shape. In FIG. 5, top shelf includes portions 111 and 112. The middle shelf includes two portions 113 and 114. The bottom shelf includes portions 115 and 116. In addition, U-shaped shelf 115, 116 also includes raised edges 104 as in FIG. 1, which extend around the perimeter of the shelf. The top shelf 111, 112 and the middle shelf 113, 114 also typically have raised edges to prevent spills. FIGS. 1 and 5 illustrate that the each of the shelves can be of a unitary extending across at least substantially all or all of the width of the refrigeration compartment or comprised of two pieces.

Figure 6:
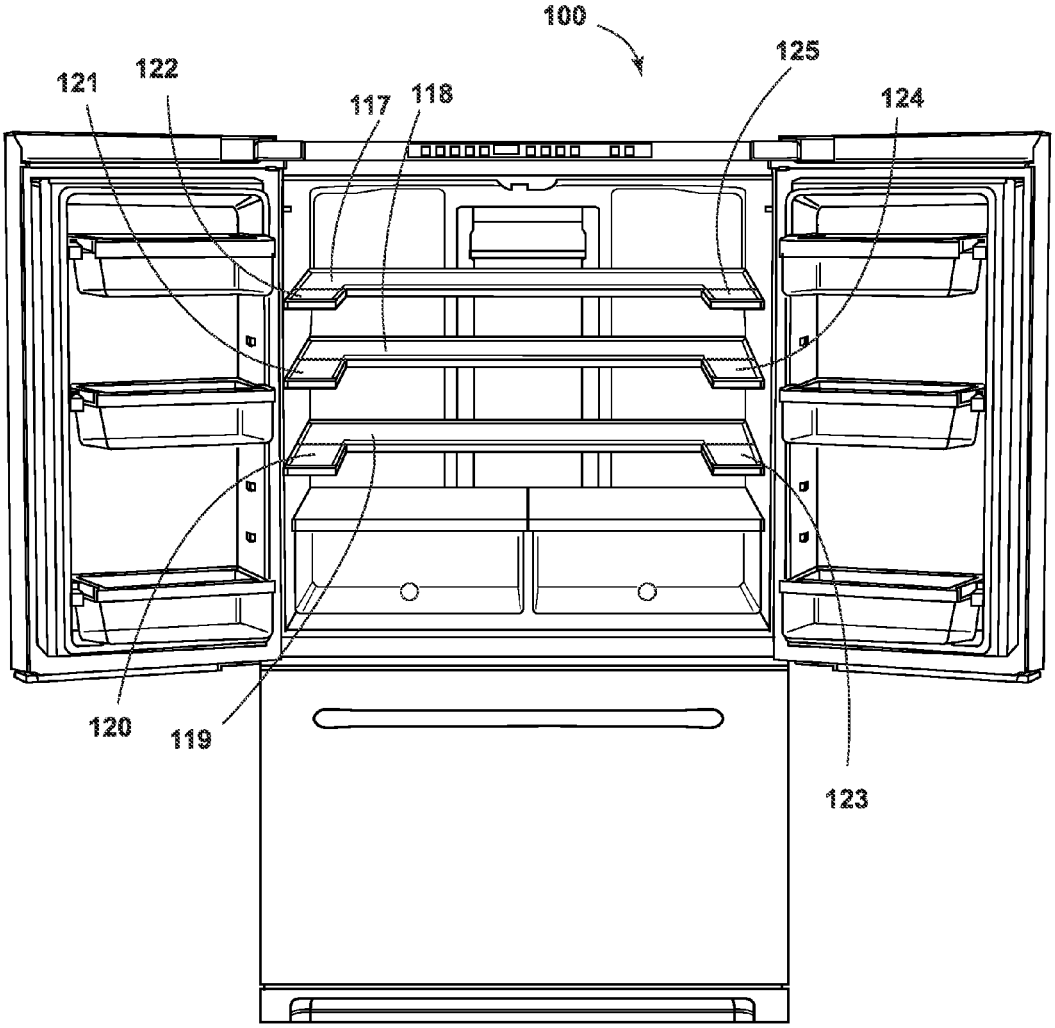
FIG. 6 is a front perspective view of a FDBM refrigerator.

FIG. 6 is a front view of a French door refrigerator with a bottom mount freezer (FDBM) with the French doors open. The refrigerator is indicated by reference number 100. In this exemplary embodiment, three U-shaped shelves are shown as in FIG. 1. However the difference between FIG. 5 and FIG. 6 is that instead of having integral one piece U-shaped shelves, as in FIG. 1, or U-shaped shelves made up of two pieces, as in FIG. 5, each of the three U-shaped shelves of FIG. 6 is made of three pieces. That is, a first shelf portion 117 extends across the back of the refrigerator cabinet. Second and third shelf portions 122, 125 each extend in a forward direction from the first shelf portion 117 on each side of the first shelf in order to form the U-shape of the U-shaped shelf. The top shelf has portions 117, 122 and 125. The middle shelf has a first shelf portion 118 extending along the back of the refrigerator cabinet, and second and third shelf positions 121 and 124 extend from the first shelf portion in a direction extending forward towards the front of the refrigerator cabinet. The bottom U-shaped shelf has a first shelf portion 119 which extends along a back of the refrigerator cabinet. Second and third shelf portions 120 and 123 extend from the first shelf portion forwardly towards the front of the refrigerator cabinet. The first, second and third shelf portions make up the third U-shaped shelf. However, the exemplary embodiments are not limited thereto and each cabinet may have any number of shelves. The U-shaped shelves of FIG. 6 and the same for the other exemplary embodiments, provide a panoramic view. Although they are not shown as having a glass tuck shelf therein, any of the shelves or all of them can have tuck shelves therein or removable shelves that are simply slidable out of the U-shape or lifted out of the U-shape by lifting the removable shelf upwards, typically straight up.

Figure 7:
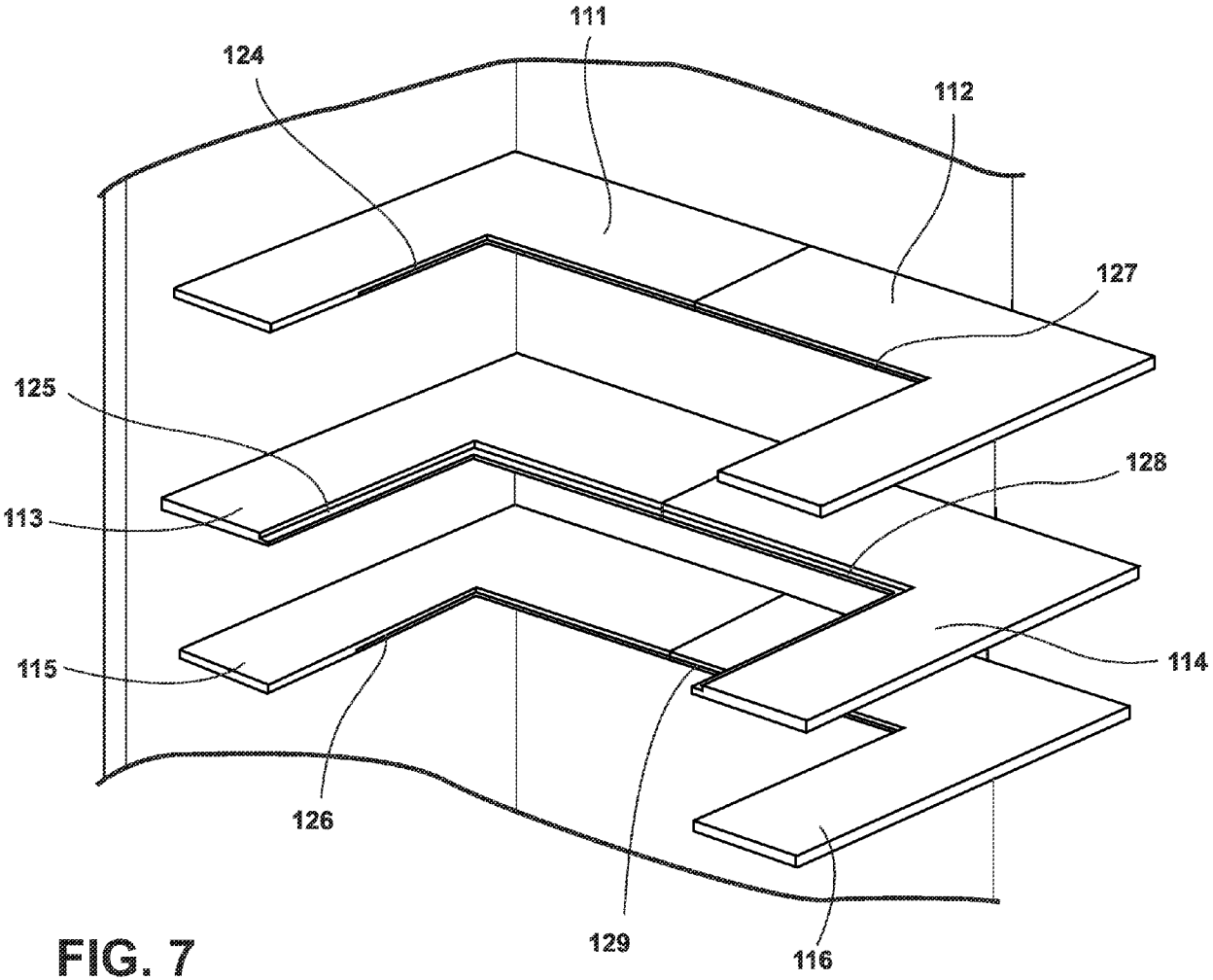
FIG. 7 is a perspective view of two piece U-shaped shelves within a FDBM refrigerator.
Figure 8:
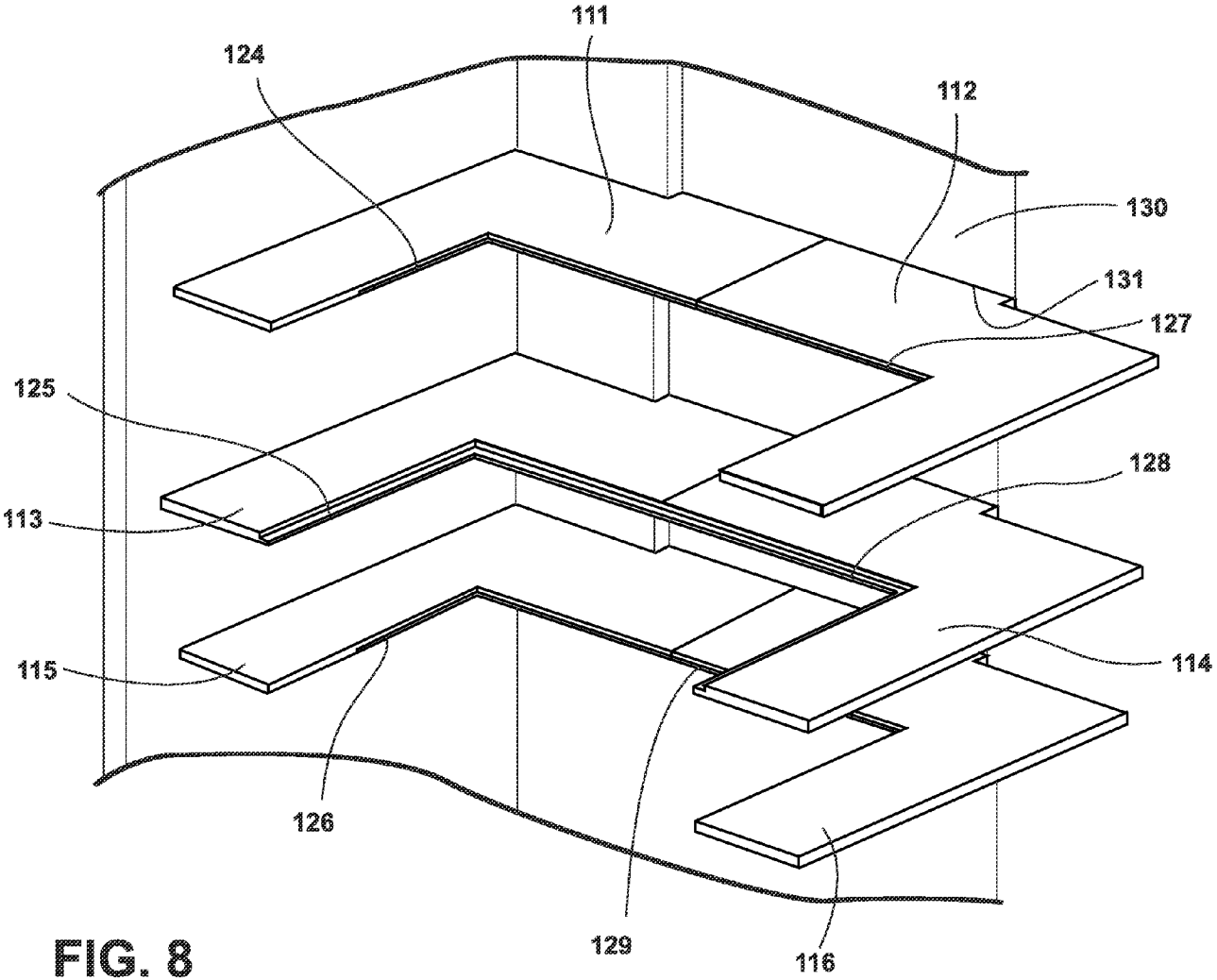
FIG. 8 is a perspective view of two piece U-shaped shelves within a FDBM refrigerator.

FIG. 7 is a perspective view of a portion of a refrigerator cabinet, which is similar to the refrigerator cabinet shown in FIG. 5. In this exemplary embodiment, each U-shaped is made of two shelf portions. In addition, each U shaped shelf may include removable shelves or tuck shelves, or both. A tuck shelf can tuck under the back portion of a U-shaped shelf or under a removable shelf. In the top shelf 111, 112 of FIG. 7, the areas 124 and 127 represent a slot in the sides and back of the U-shaped shelf. The slot in the edges of the U-shaped shelf are configured to receive a projection extending from them to receive a projection on the sides of a tuck shelf in order for the tuck shelf (not shown) to be tucked in and placed under the back of the U-shaped shelf 111, 112. The middle shelf 113, 114, includes a ledge 125, 128 at the bottom that projects in the direction of the center of the refrigerator cabinet. The U-shaped shelf 113, 114 have a ledge onto which a removable shelf (not shown) could be placed. This removable shelf is not tuckable into the back of the U-shaped shelf but rather can be lifted up or simply slid out of place to remove it from a refrigerator cabinet to make room for taller items on the shelf or shelves below. In addition, a bottom U-shaped shelf is typically the same as top shelf 111, 112 and has grooves therein 126, 129 for receiving a tuck shelf that could be put into place and slid in under the back of the U-shape to provide more space for taller items below U-shaped shelf 113, 114 in the refrigerator cabinet. In FIGS. 7 and 8, slots 127, 129 are deeper than slots 124, 126 in order to receive tuck shelves (not shown).

FIG. 8 is a perspective view also similar to FIG. 5. The difference between FIG. 8 and FIG. 5 is that the back of the cabinet of the refrigerator, in which the U-shaped shelf extends, is non-linear or rather, has a recess portion 130 at the back of the refrigerator cabinet. Accordingly, there is a corresponding projection area 131 on the back of each of the U-shaped shelves 111, 112, 113, 114, 115 and 116.

Figure 9:
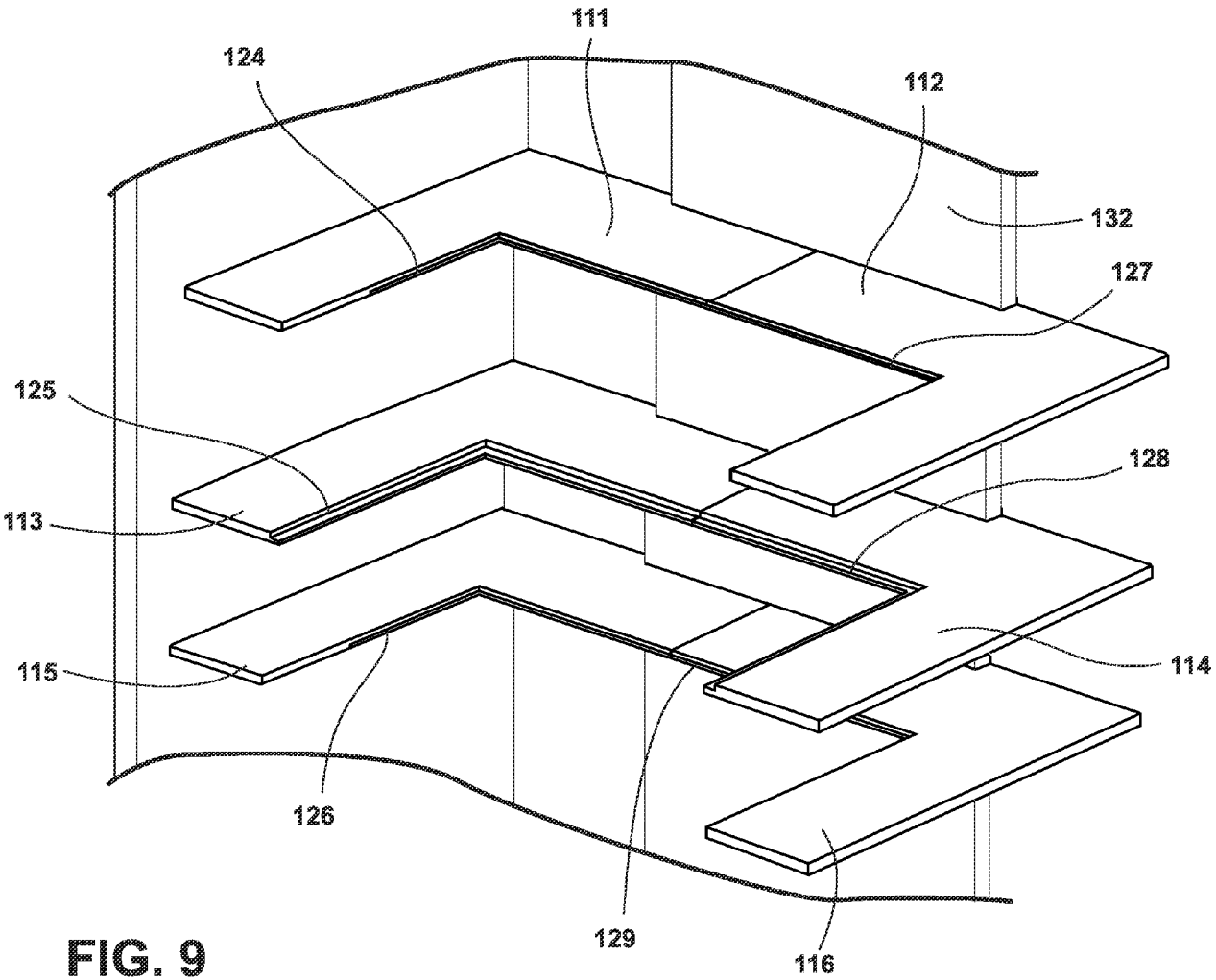
FIG. 9 is a perspective view of two piece U-shaped shelves within a FDBM refrigerator.

FIG. 9 is similar to FIG. 7 with the exception that instead of there being a recessed area in the back of the refrigerator cabinet there is a projecting area that projects a short distance into the area of the back of the center of the cabinet and projects into the food area of the refrigerator cabinet. As shown, the sections 132 of the projection and the refrigerator hold the back of the U-shaped shelves in place. Accordingly, the U-shaped shelves do not have a recess in them for the area 132 but rather are continuously going across and there are openings in the projecting portion 132 in the back of the cabinet to receive the back of the shelves. However, the exemplary embodiments are not limited thereto and it is within the scope of one of ordinary skill in the art that each of the two pieces making up the U-shaped shelf can have a recess in them to receive the projection 132 within the cabinet. In addition, in this exemplary embodiment, the back portion of the U-shape of the U-shaped shelves has a larger depth than in FIG. 7, for ease or receiving a tuck shelf under the top U-shaped shelf 111, 112 or the bottom U-shaped shelf 115, 116.

Figure 10:
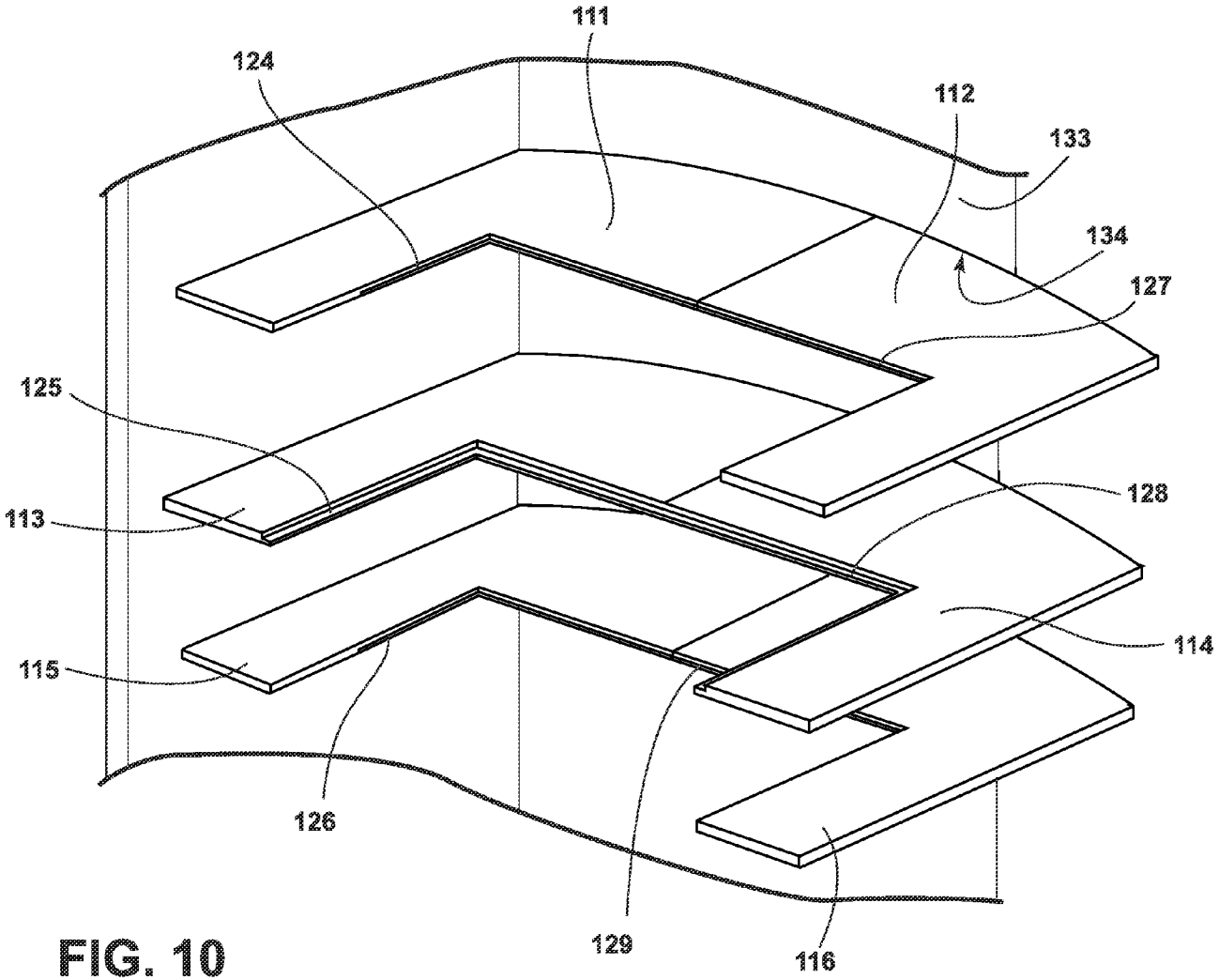
FIG. 10 is a perspective view of two piece U-shaped shelves within a FDBM refrigerator.
Figure 11:
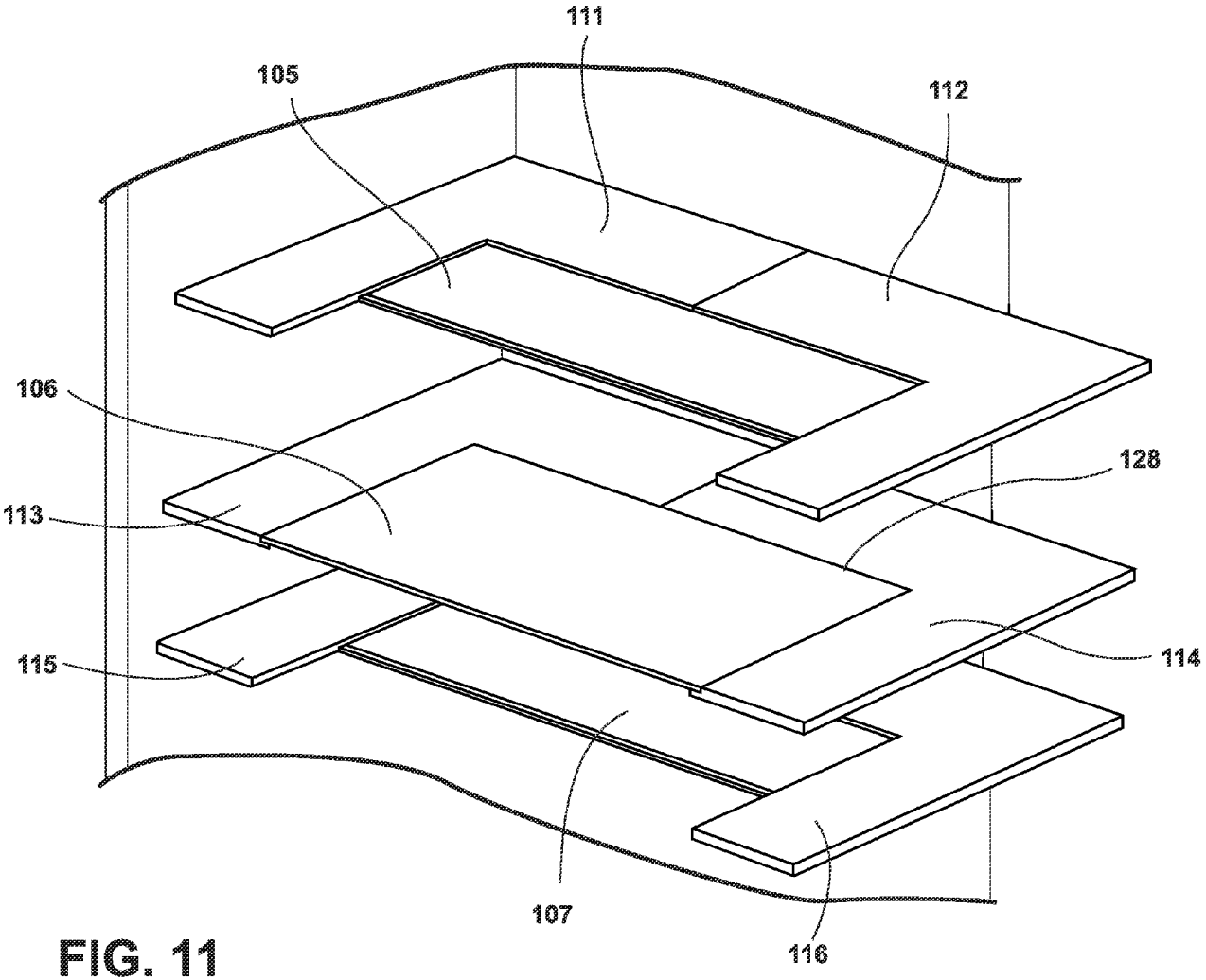
FIG. 11 is a perspective view of two piece U-shaped shelves within a FDBM refrigerator where the shelves have glass inserts which may be removable shelves or tuck shelves.

FIG. 10 is an alternate embodiment of a refrigerator cabinet having a curved back wall 133, which receives U-shaped shelves. The U-shaped shelves have a corresponding curved surface 134 at the back of each U-shaped shelf. The back of the cabinet providing more room for food within the cabinet. As a result, the back of each of the three shelves that are made up of two parts in this exemplary embodiment is curved to conform to the shape of the cabinet. The tuck portion of the shelf typically will remain rectangular shaped FIG. 11 is a perspective view similar to FIG. 7 with the exception that this figure shows two tuck shelves within U-shaped shelves 111, 112 and 115, 116. A top U-shaped shelf 111, 112 has a first tuck shelf 105 that can slide in a horizontal manner under the back of the U-shaped shelf 111, 112. The second U-shaped shelf 115, 116 has a tuck shelf 107. In addition, middle U-shaped shelf 113, 114 has a removable shelf 106 therein. The removable shelf may be slid or lifted out of the U-shaped shelf. In addition, the removable shelf, as shown, fills the U-shape of the U-shaped shelf 115, 116 but can be configured to fill less than all of the U-shape of this U-shaped shelf when in the extracted position. In addition, tuck shelves 105 and 107 can be replaced with removable shelves. Alternatively, there may be no shelves within the center portions of the U-shaped shelves of this exemplary embodiment.

Figure 12:
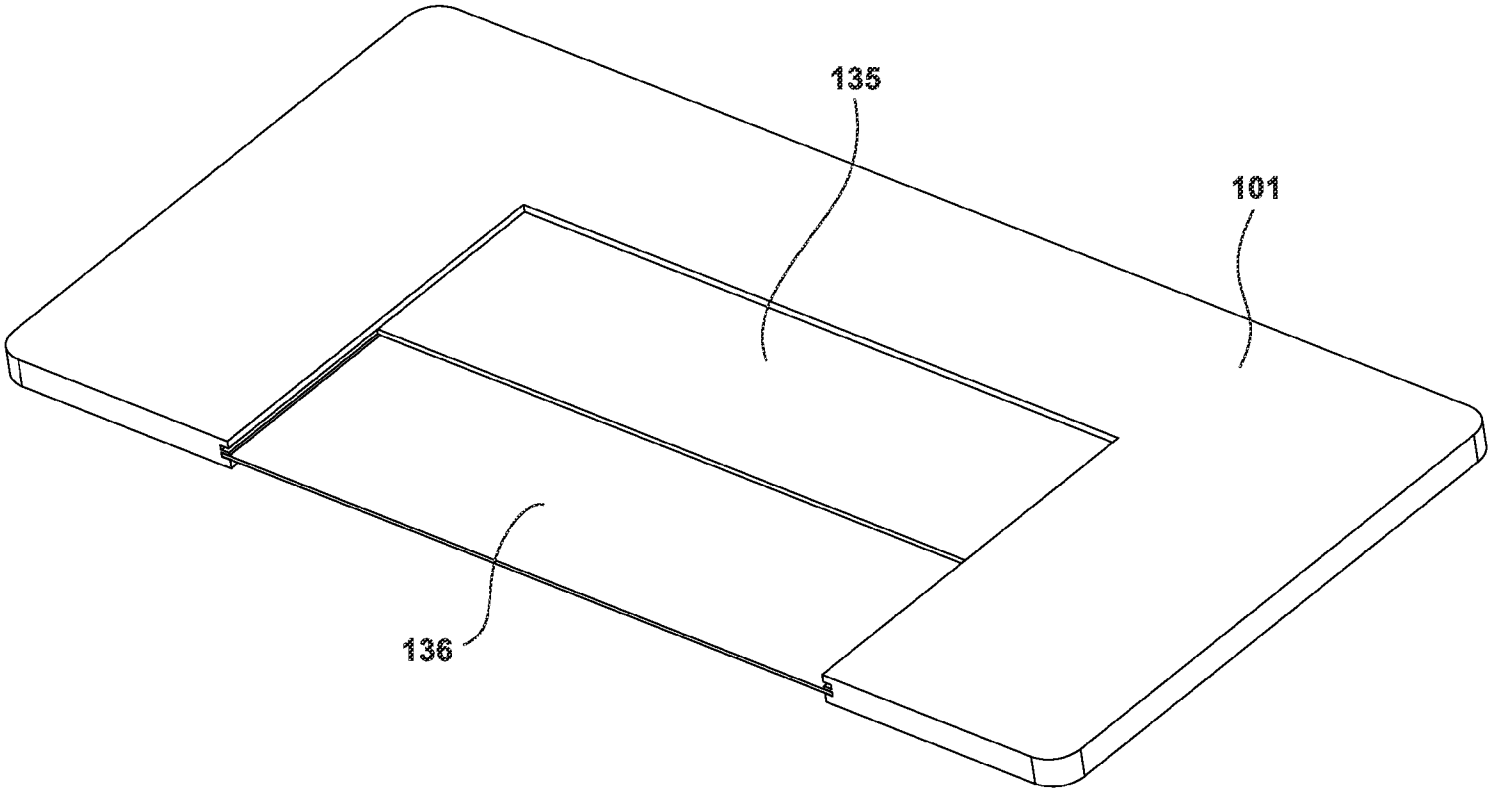
FIG. 12 is a perspective view of a U-shaped shelf having a removable shelf and a tuck shelf.

FIG. 12 is an exemplary embodiment of a U-shaped shelf 101 having therein a removable center shelf 135 and a center tuck shelf 136. Removable shelf 135 is fixed in place. The second shelf 136 which is lower than shelf 135 for tucking under shelf 135 in a horizontal fashion is in a slot or groove under shelf 135 so that shelf 136 can tucked below shelf 135 to make more room for large items below U-shaped shelf 101. This is typically accomplished by a user pushing shelf 136 under shelf 135 into a retracted position or pulling the shelf 136 into an extended/extracted position.

Figure 13:
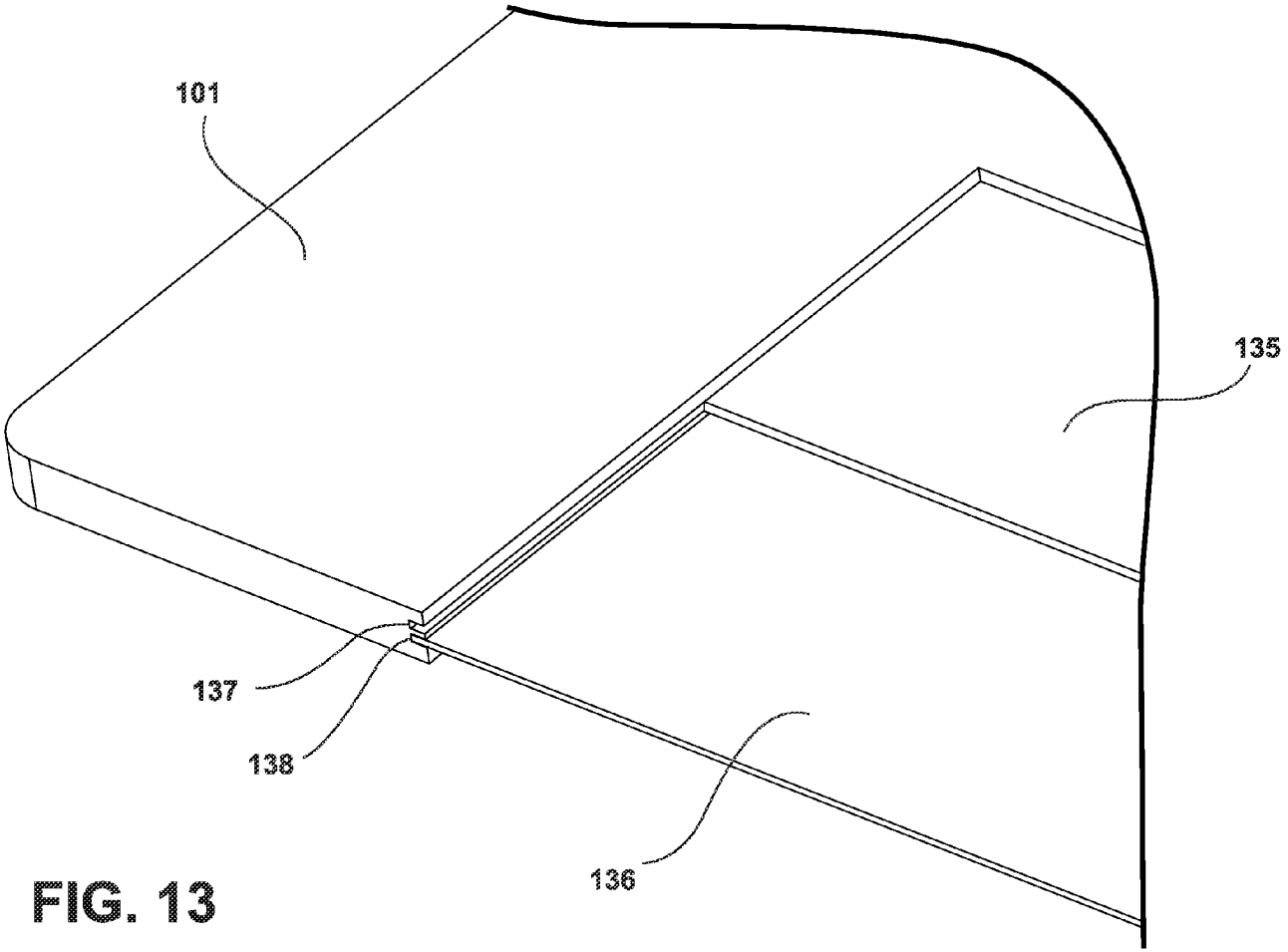
FIG. 13 is a perspective view similar to FIG. 12 showing the support structure for the removable shelf and the tuck shelf with a U-shaped shelf.

FIG. 13 is a perspective view of a portion of FIG. 12. FIG. 13 illustrates a portion of shelf 101 as well as removable glass shelf 135 and tuck shelf 136 with tuck shelf 136 being tuckable under shelf 135 in a horizontal fashion. In addition, FIG. 13 shows grooves or slots 137 and 138. Groove or slot 137 receives glass shelf 135 and groove or slot 138 receives glass tuck shelf 136.

Figure 14:
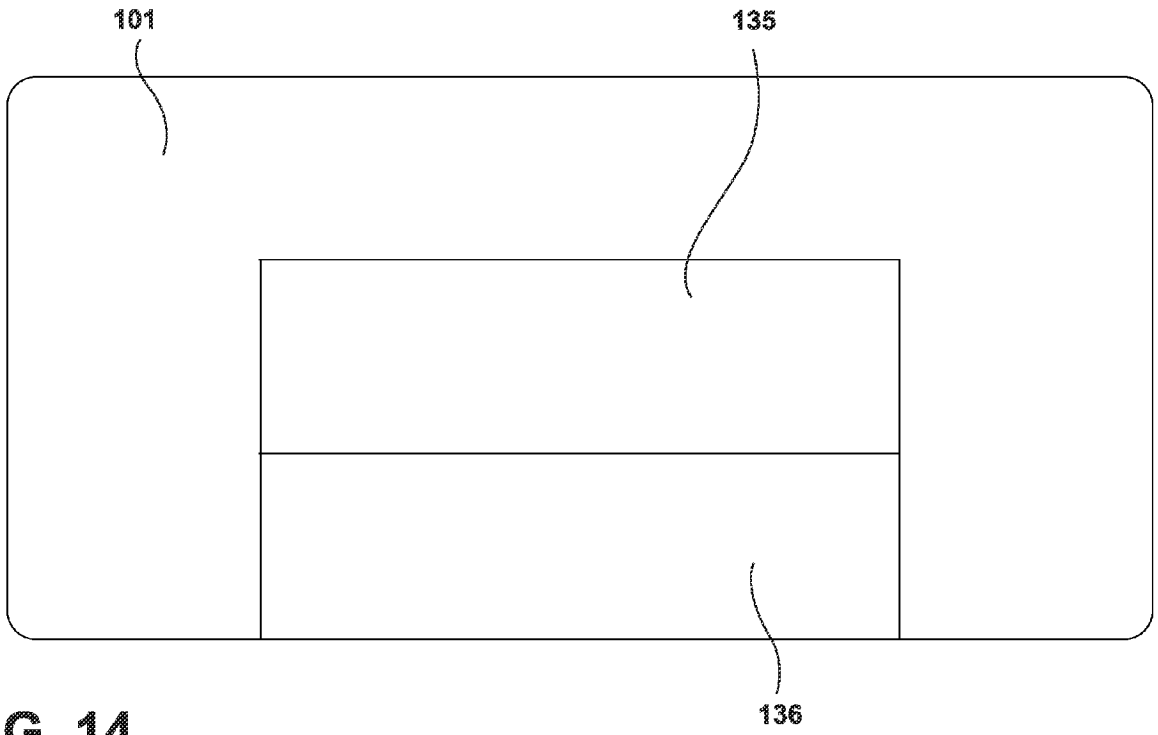
FIG. 14 is a bottom view of the U-shaped shelf of FIG. 13.

FIG. 14 is a plan view of FIG. 13.

Figure 15:
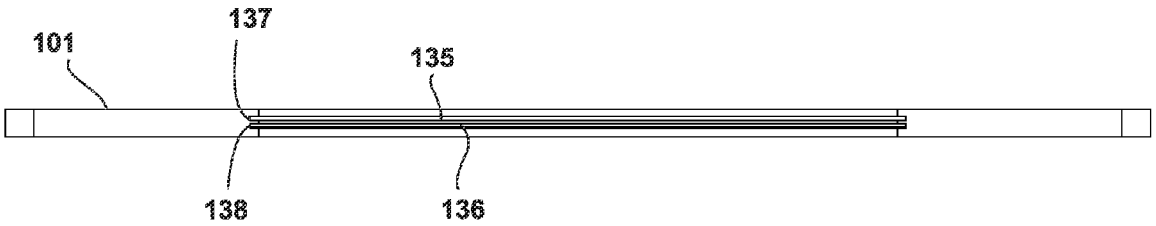
FIG. 15 is a side view of the U-shaped shelf of FIG. 14.

FIG. 15 is a front view of FIG. 13 and shows the grooves 137 and 138 in the U-shaped shelf 101. FIG. 15 also shows upper glass shelf 135 and lower glass shelf 136. Alternatively, the removable shelf may be below the tuck shelf.

Figure 16:
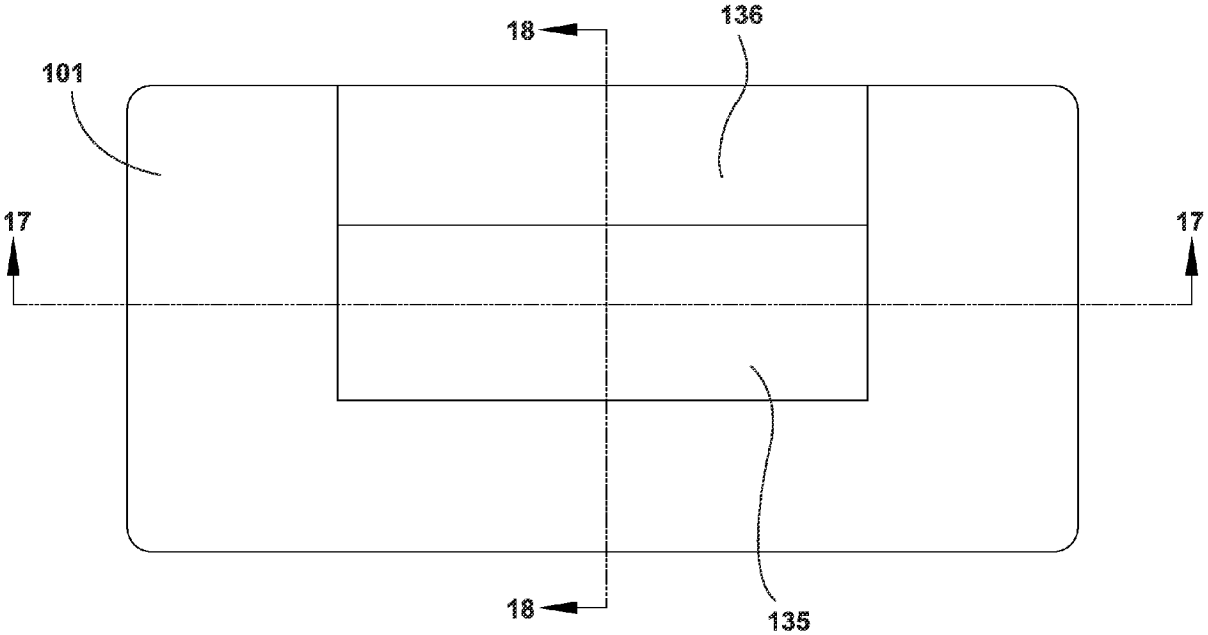
FIG. 16 is bottom view of FIG. 14.

FIG. 16 is a bottom view of the U-shaped shelf 101 and glass shelves 135 and 136 of FIG. 12.

Figure 17:
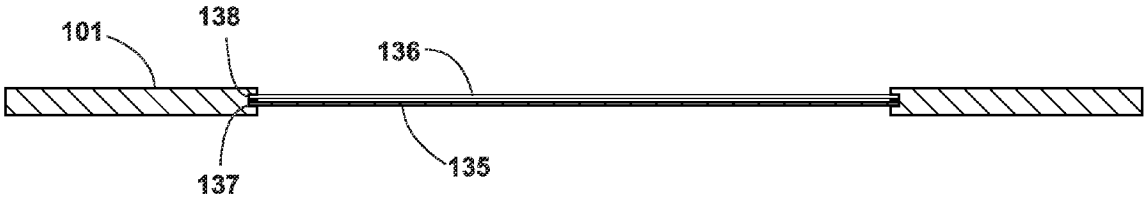
FIG. 17 is a cross-sectional view of FIG. 16, taken along the lines 17-17 of FIG. 16.

FIG. 17 is a bottom cross-sectional view of the U-shaped shelf 101 of FIG. 16, taken along the lines 17-17 of FIG. 16. In FIG. 17, grooves 137 and 138 and the shelves 135 and 136 are illustrated. Because FIG. 17 is a bottom cross-sectional view of the U-shaped shelf 101, the vertical orientation of grooves 137 and 138 and glass shelves 135 and 136 are shown reversed from FIG. 15.

Figure 18:
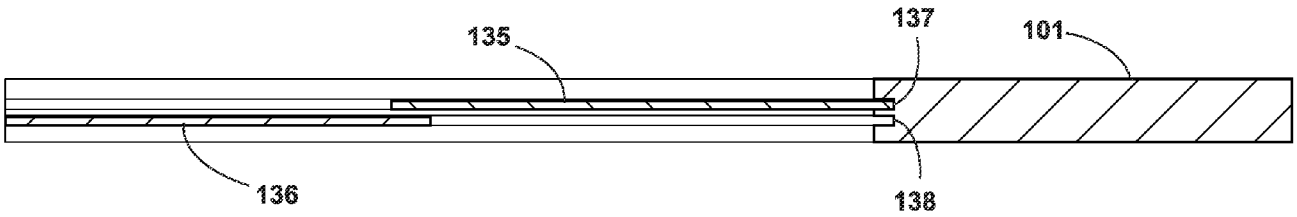
FIG. 18 is a cross-sectional view of FIG. 16, taken along the lines 18-18 of FIG. 16.

FIG. 18 is a cross-sectional view of FIG. 16 taken along the lines 18-18 of FIG. 16. FIG. 18 shows U-shaped shelf 101 along with grooves 137, 138 and glass shelves 135 and 136.

Figure 19:
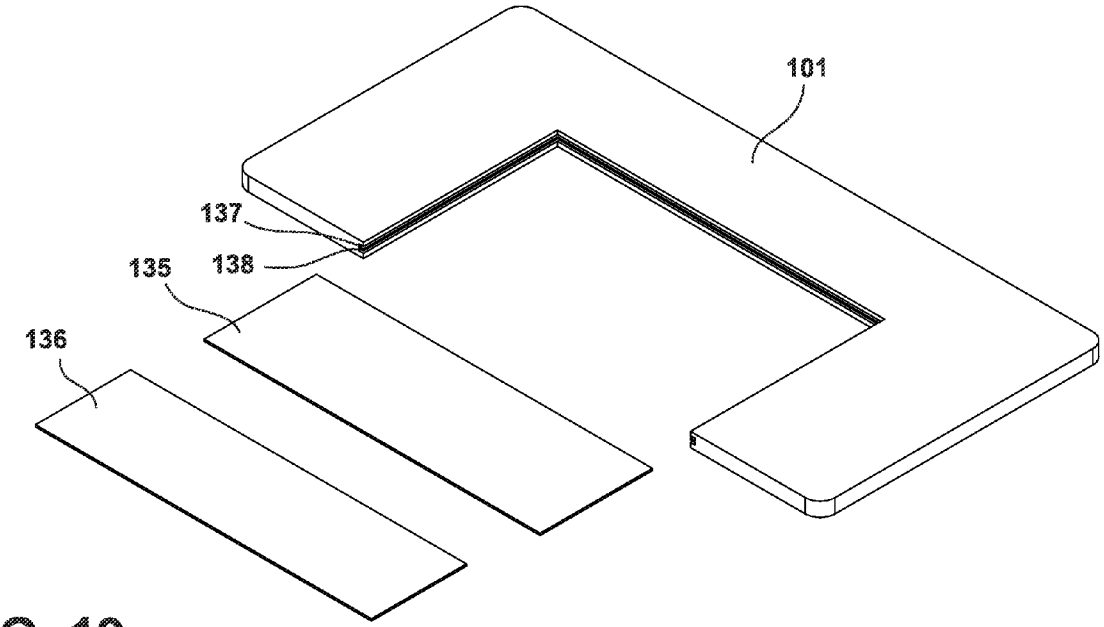
FIG. 19 is an exploded view of the U-shaped shelf of FIG. 12.

FIG. 19 is an exploded view of FIG. 18. FIG. 19 illustrates U-shaped shelf 101 and grooves 137 and 138 within U-shaped shelf 101. Additionally, FIG. 19 shows the two glass shelves 135, 136 with removable shelf 135 in the upper groove and tuck glass shelf 136 in the lower groove, so that tuck shelf 136, made of glass, can tuck under removable shelf 135. Not shown in this figure are raised edges around the U-shaped shelf 101 to prevent liquids from spilling off the shelf.

Figure 20:
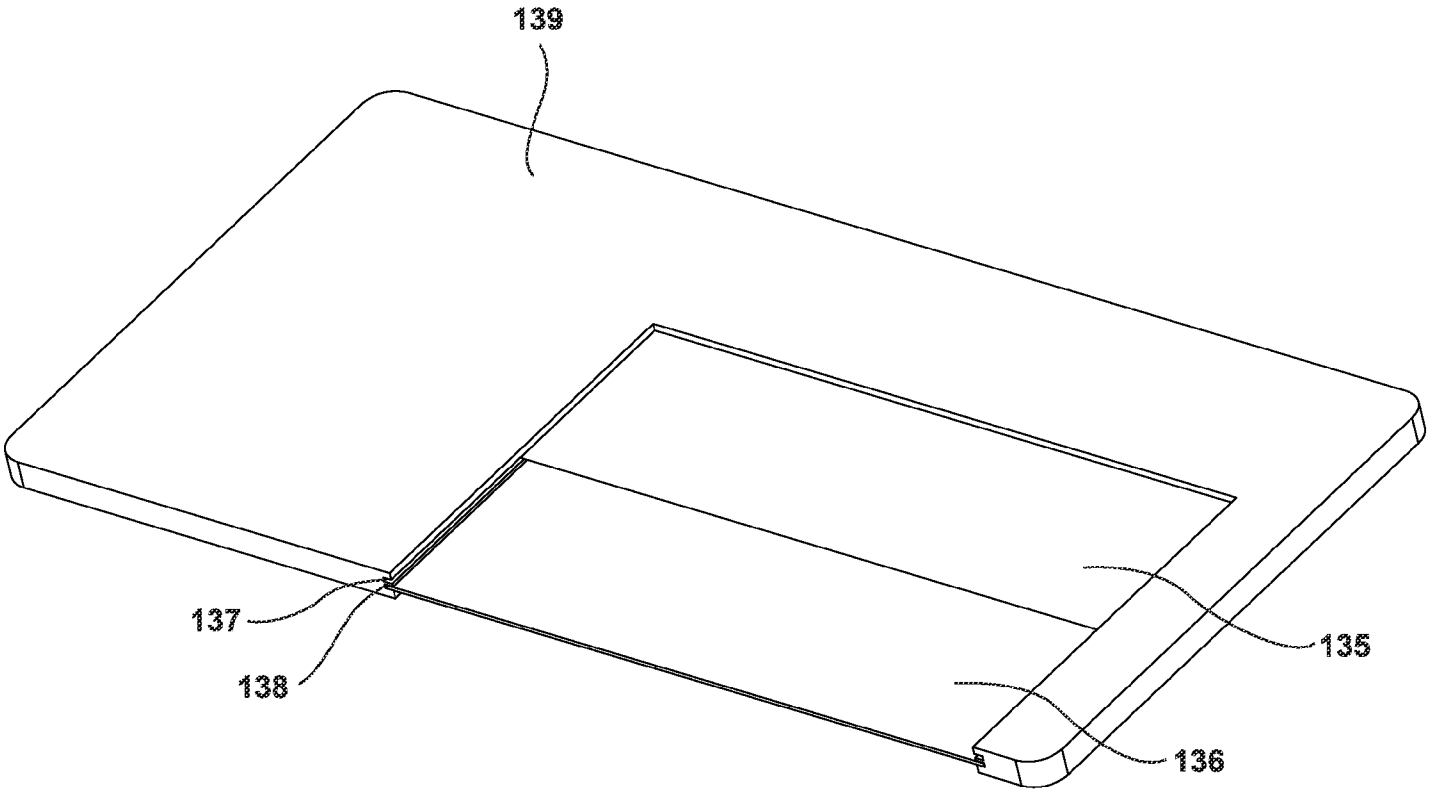
FIG. 20 is a perspective view of an off-set U-shaped shelf.

FIG. 20 is an exemplary embodiment showing an offset U-shaped shelf wherein the solid offset U-shaped shelf 139 has the right side of the U-shape narrower than the left side of the U-shape. Within the U-shape may be a permanent or a removable shelf 135 and a tuck shelf 136, which tucks under the removable shelf 135 to provide more room in the refrigerator cabinet for taller items of positioned on shelves below the offset U-shaped shelf. The taller items can extend beyond the height of the offset U-shaped shelf when the tuck shelf is retracted below the permanent or removable shelf 135.

Figure 21:
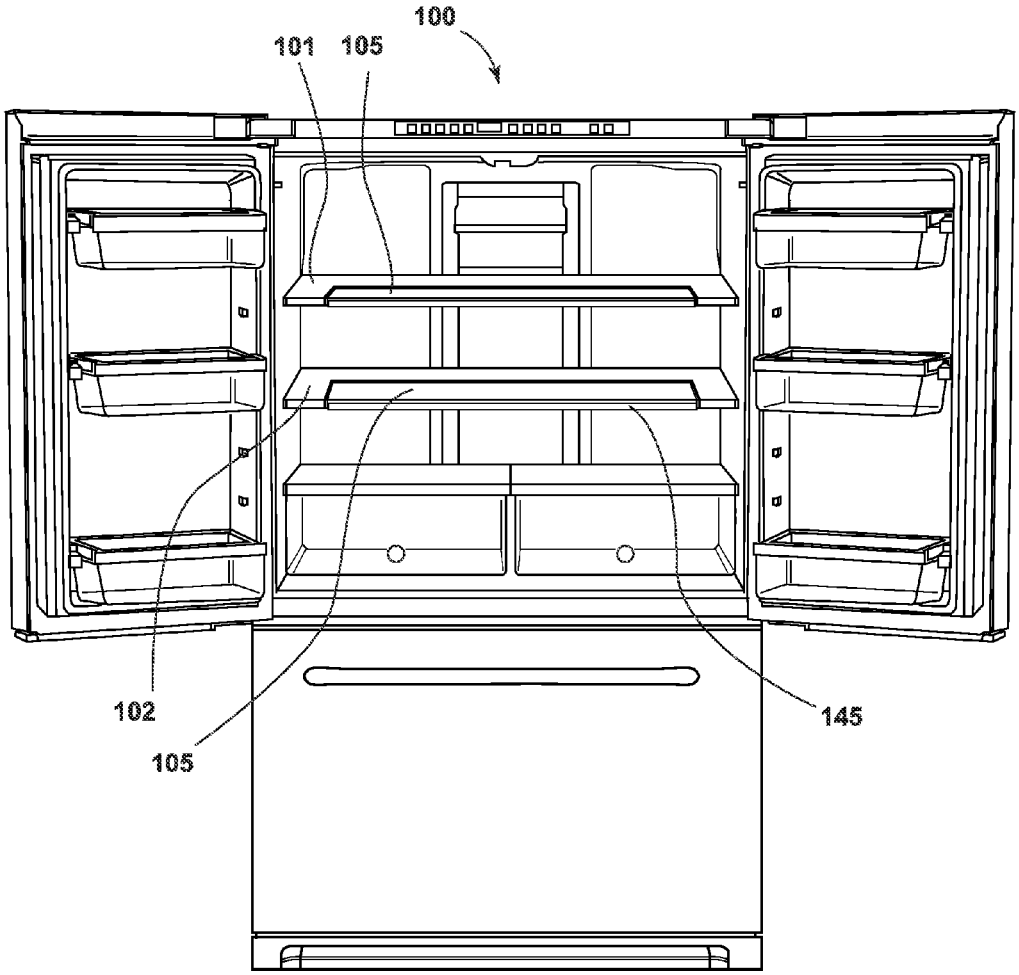
FIG. 21 is a front view of a FDBM refrigerator in which each of the U-shaped shelves have a removable shelf therein.

FIG. 21 is a front view of a FDBM refrigerator 100 that shows, inter alia, two shelves 101 and 102 therein extending across the width of the interior volume of the refrigerator compartment. These shelves 101 and 102 are similar to the shelves in FIG. 1. The difference between this FIG. 21 and FIG. 1 is FIG. 21 also shows a tuck shelf that fills the U-shape and this tuck shelf can either stay where it is or it can slide under the back of the center of the U-shaped shelf. The tuck shelves are referred to as 105 as are the same shelves in both locations and in addition trim 145 is shown on the front of the lower shelf to make it easier to grasp the shelf to slide it in and out of the tucked and extended position or any user selectable position therebetween.

Figure 22:
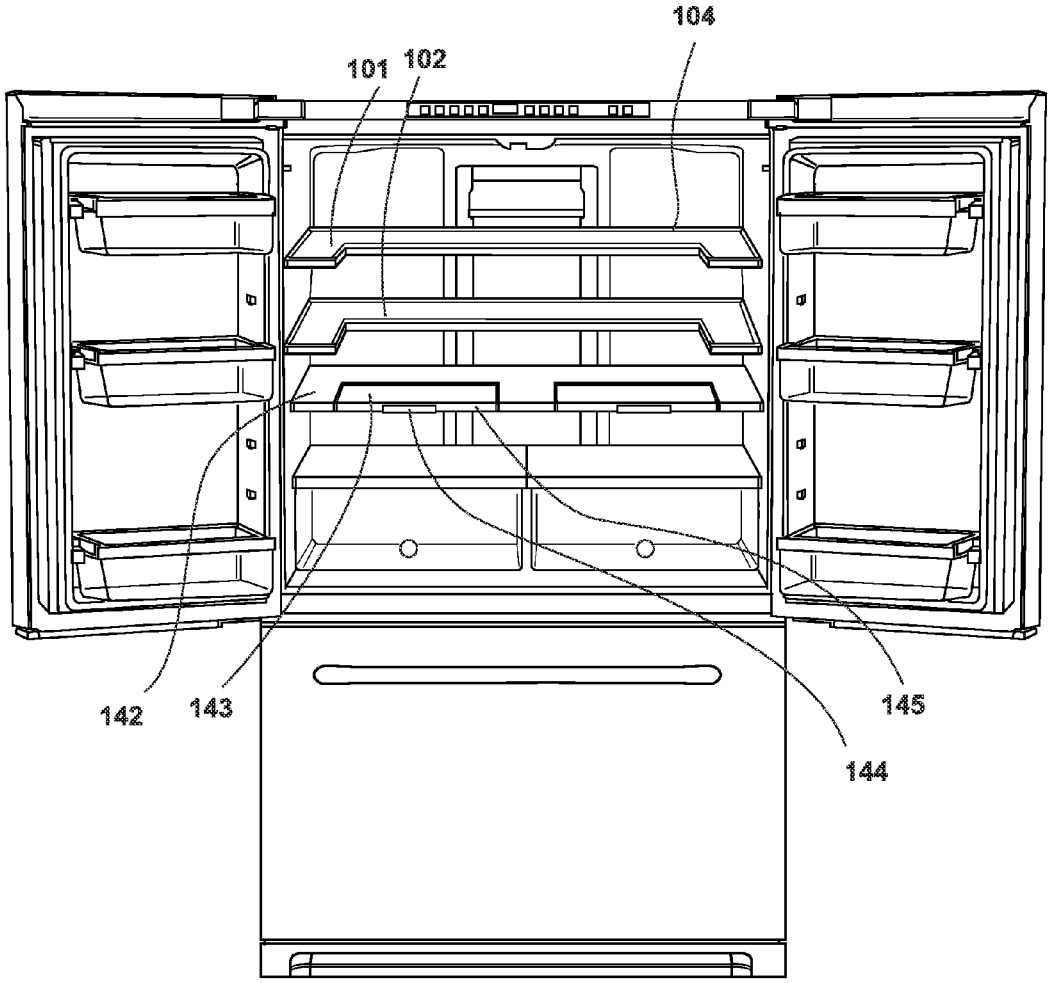
FIG. 22 is a front view of a FDBM refrigerator having a plurality of U-shaped shelves wherein one of the U-shaped shelves has two side-by-side glass shelves therein.

FIG. 22 is a front view of a FDBM refrigerator with the French doors in an open position. In this exemplary embodiment, there are three shelves similar to the shelves of FIG. 1. The top two shelves 101 and 102 also have a raised edge 104 around the perimeter to prevent spillage or sliding of comestibles or containers of comestibles off the shelf. In addition, the third shelf 142 is different and has therein two tuck shelves 143. Each of the two tuck shelves 143 are spaced apart so that they are a mirror image of each other. The two tuck shelves are centered with respect to the U-shaped shelf. The unitary U-shaped shelf 142 is actually somewhat W-shaped because a center part of the shelf projects outwardly from the back of the U-shape between the sides of the tuck shelves. In addition, the tuck shelves each have a trim 145 in the front of the shelf as well as a handle 144 for ease in moving the shelf in and out of the tuck position. When such a W-shape is utilized, a bracket beyond the attachment system used to mount the shelves 101, 102 may be employed if a center bracket is not implemented to retain/support shelves 101, 102. The bracket that supports the center section of the W-shaped bracket may be longer than any center support bracket used to support shelves 101, 102 due to the different locations of the tuck shelves 143.

Figure 23:
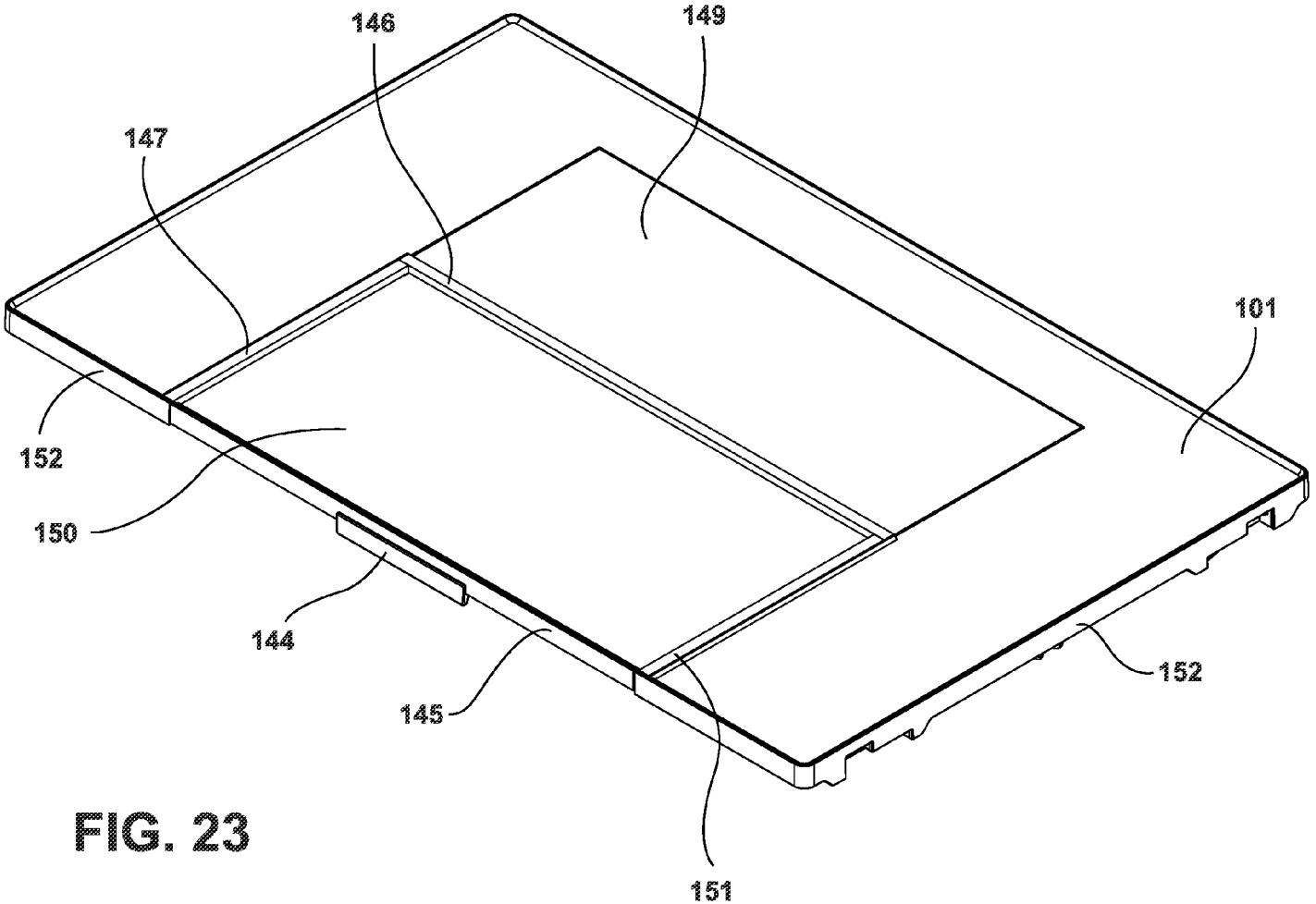
FIG. 23 is a perspective view of a U-shaped shelf having a removable shelf made from a solid material and a tuck shelf of a solid material.

FIG. 23 is a U-shaped shelf similar to the shelf of FIG. 12. In FIG. 23, the solid back portion of the U-shape is of smaller depth than the back of the U-shaped shelf of FIG. 12. Shelf 101 is a U-shaped shelf. In FIG. 23, removable shelf 149 is made of a solid material as is tuck shelf 150. Removable shelf 149 and tuck shelf 150 are not glass shelves and are made of plastic, wood, or wood-look material. FIG. 23 also shows the trim molding 146 in the front of removable shelf 149 which fits in the center of the U-shape against a back portion of the U-shape. Additionally shown are trim 147 and trim 151, which are on the sides of the U-shaped shelf where the U-shaped shelf abuts the solid material tuck shelf 150. In addition, trim 152 is provided, which extends around the perimeter of the tuck shelf 150 and trim 145 shown in front of the tuck shelf 150. A handle 144 is located in the front center of the trim 145 of the tuck shelf 150. While optional, the handle 144 makes it easier to slide tuck shelf 150 below solid removable shelf 149.

Figure 24:
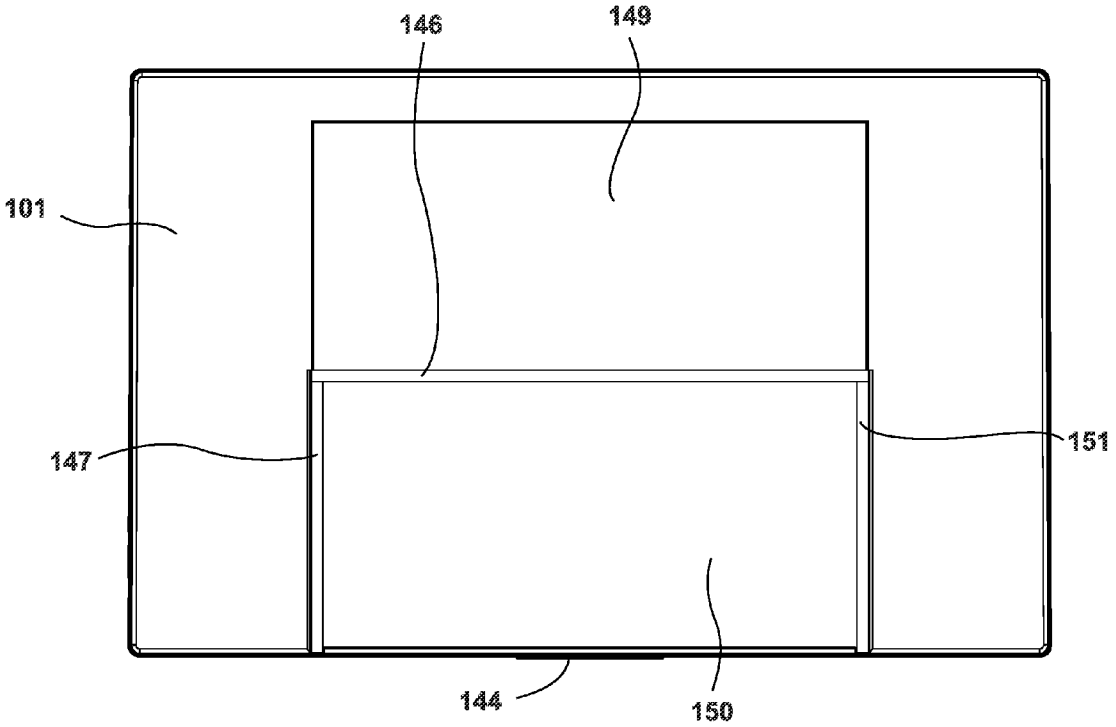
FIG. 24 is a plan view of the U-shaped shelf of FIG. 23.

FIG. 24 is a plan view of FIG. 23.

Figure 25:
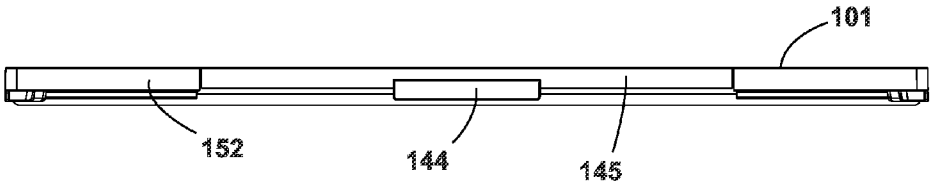
FIG. 25 is a front view of the U-shaped shelf of FIG. 24.

FIG. 25 is a front view of FIG. 23 which shows U-shaped shelf 101, U-shaped shelf trim 152, tuck shelf trim 145 and handle 144, located at the center of tuck shelf 150.

Figure 26:
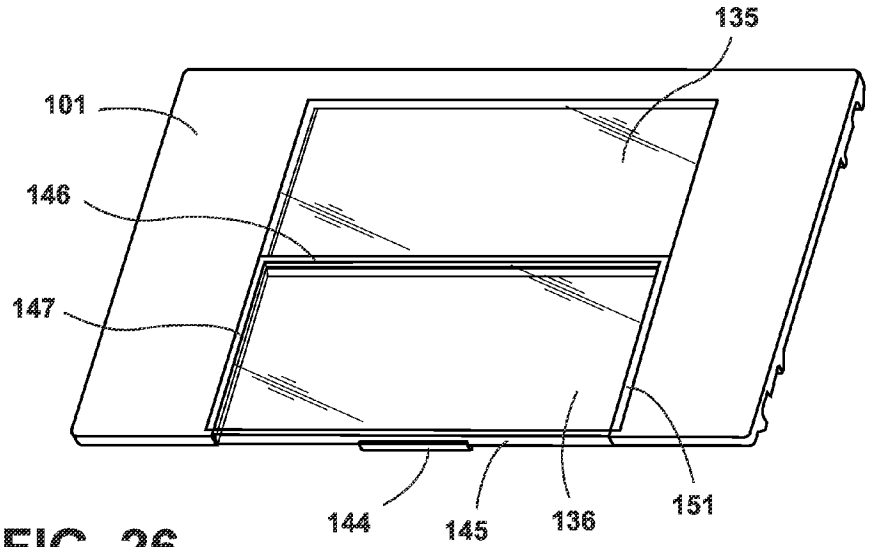
FIG. 26 is a perspective view of a U-shaped shelf similar to FIG. 24 but having a removable shelf and a tuck shelf made of glass.

FIG. 26 is similar to FIG. 23. The difference that the removable shelf 135, which fits into the back of the U-shape of the U-shaped shelf 101 and the tuck shelf 136, which tucks under removable shelf 135 are both made out of glass. In the exemplary embodiment of FIG. 23, the two shelves are made out of a non-glass solid, non-transparent material such as plastic, wood or material with a wood-look. However, the exemplary embodiments are not limited thereto and any combination of materials can be used for the removable shelf 135 and the tuck shelf 136.

Figure 27:
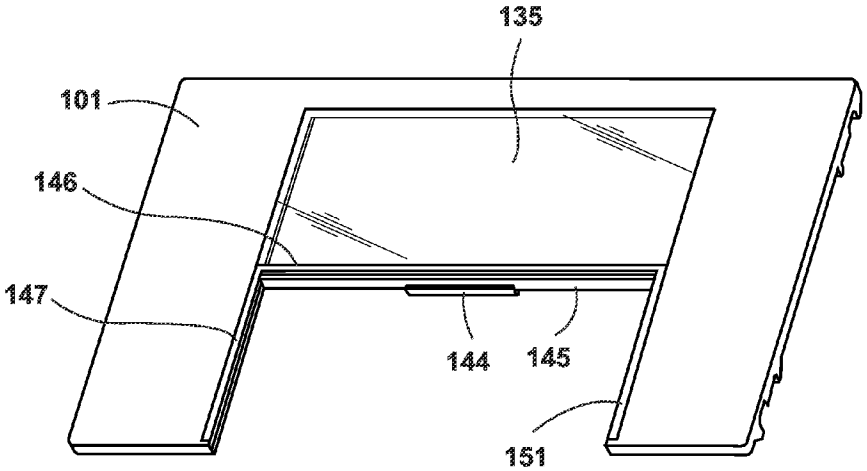
FIG. 27 is a perspective view of the U-shaped shelf of FIG. 26 with the tuck shelf in a tucked position under the removable shelf.

FIG. 27 is similar to FIG. 26 but shows bottom tuck shelf 136 tucked in place under upper removable shelf 135.

Figure 28:
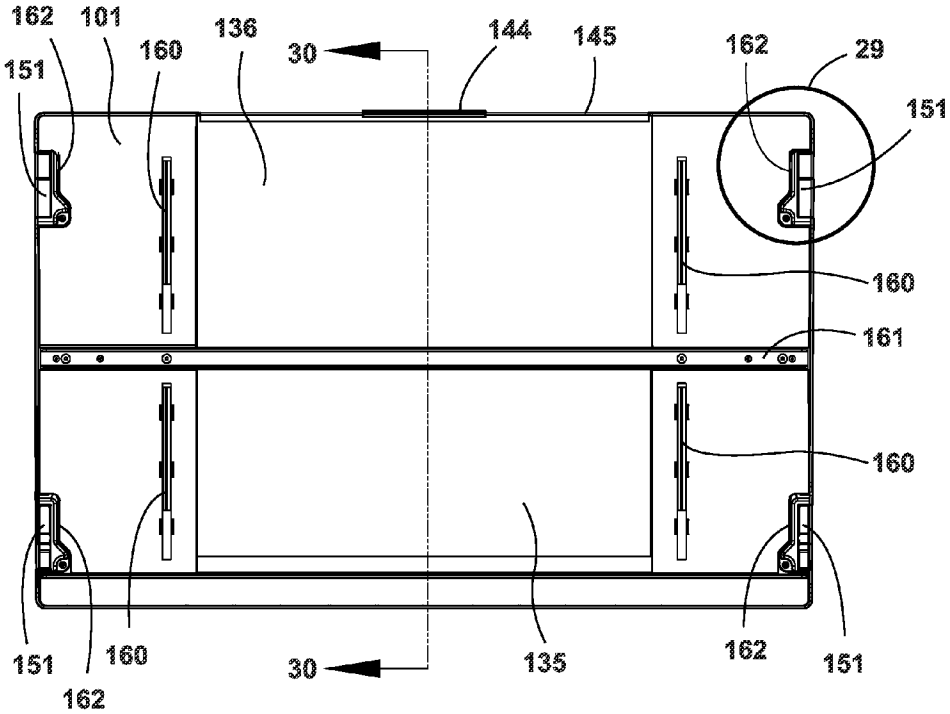
FIG. 28 is a bottom view of the U-shaped shelf of FIG. 26; showing a mechanism for lighting the area below the U-shaped shelf as well as the electrical connectors for the light.

FIG. 28 is a bottom view of the U-shaped shelf 101 of FIG. 27. FIG. 28 illustrates four light fixtures 160, which are typically LED light fixtures, mounted to the underside of the U-shaped shelf. In addition, FIG. 28 shows electrical connectors 151, which are configured to be connected to an electric power supply provided by the appliance for providing illumination from lights 160 to provide light below the shelf in a unique lighting distribution achieved through the use of the shelf configuration of the present disclosure.

Figure 29:
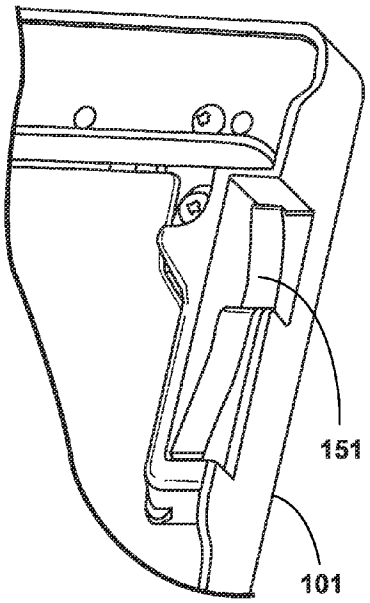
FIG. 29 is an enlarged cut-away view of the circled upper right corner of FIG. 28.

FIG. 29 is an enlarged view of the upper right corner of FIG. 28 that shows an enlarged view of one of the electrical connectors 151.

Figure 30:
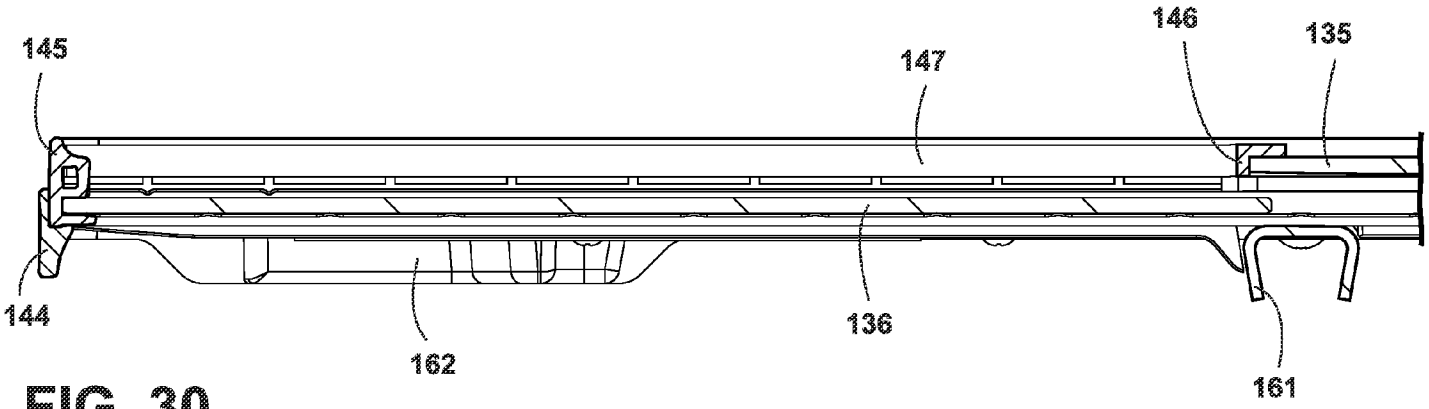
FIG. 30 is a cross-sectional view of the U-shaped shelf of FIG. 28 taken along the lines 30-30 in FIG. 28.

FIG. 30 is a cross-sectional view of FIG. 28 taken along the lines 30-30 of FIG. 28. This figure shows a covering 162 for an electrical connector 151, as well as a downwardly extending handle 144 for moving the tuck shelf 136 into and out of a tucked position under removable shelf 135. FIG. 30 also illustrates a cross-section of the trim 145 for the tuck shelf 136. In addition, FIG. 30 also illustrates an inverted U-shaped bracket running along the center of the U-shaped shelf and providing support thereto. Also, in FIG. 30, the tuck shelf 136 is shown in a retracted position and the removable shelf 145 is shown in position above tuck shelf 136. Trim 146 is for removable shelf 135. Trim 147 is located on the inside of the left side of the U-shaped shelf in the area where the tuck shelf abuts the left side of the U-shape of the U-shaped shelf.

Figure 31:
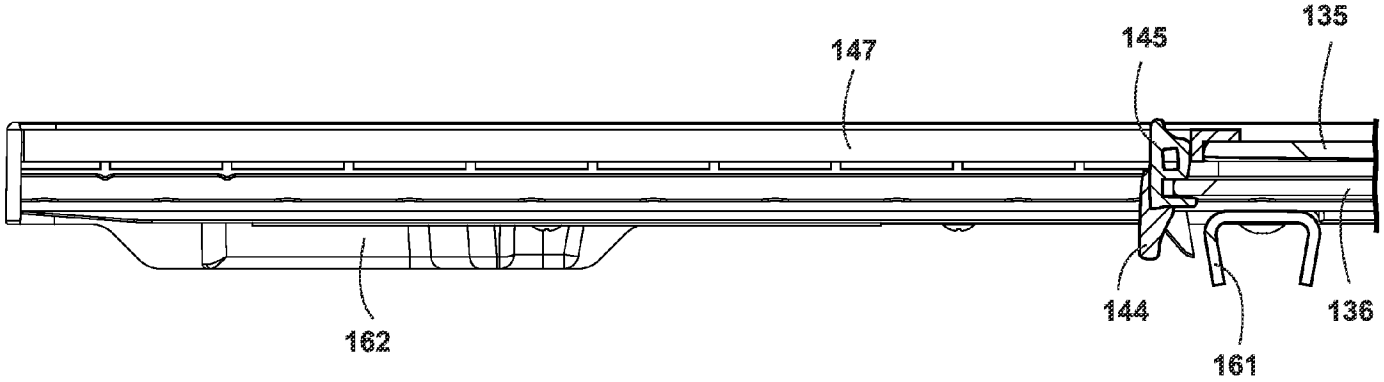
FIG. 31 is a similar view of FIG. 28 showing the tuck shelf of the U-shaped shelf tucked below the upper removable shelf.

FIG. 31 is a view similar to FIG. 30, but shows tuck shelf 136 fully tucked under removable shelf 135. As can be seen in FIG. 31, handle 144 and trim 145 are moved to the right when the tuck shelf 136 tucks under the removable shelf 135.

Figure 32:
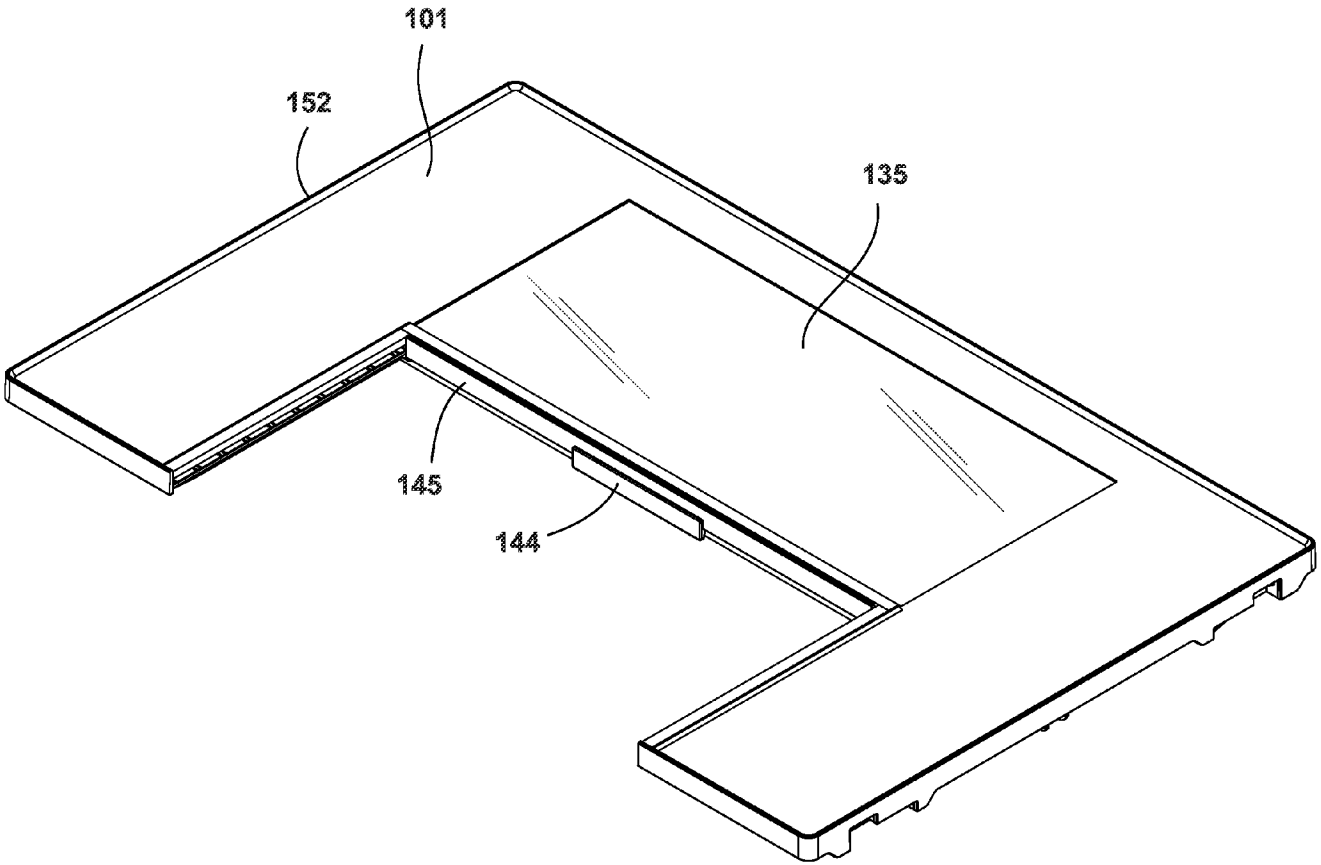
FIG. 32 is a perspective view of a U-shaped shelf.

FIG. 32 is a perspective view of a U-shaped shelf 101 having a trim 152 around the perimeter of the U-shaped shelf. The trim 152 can be used in lieu of a raised edge to prevent spillage. FIG. 32 also shows a front trim 145 for the tuck shelf (not shown), as well as handle 144 for ease in moving the tuck shelf into and out of position.

Figure 33:
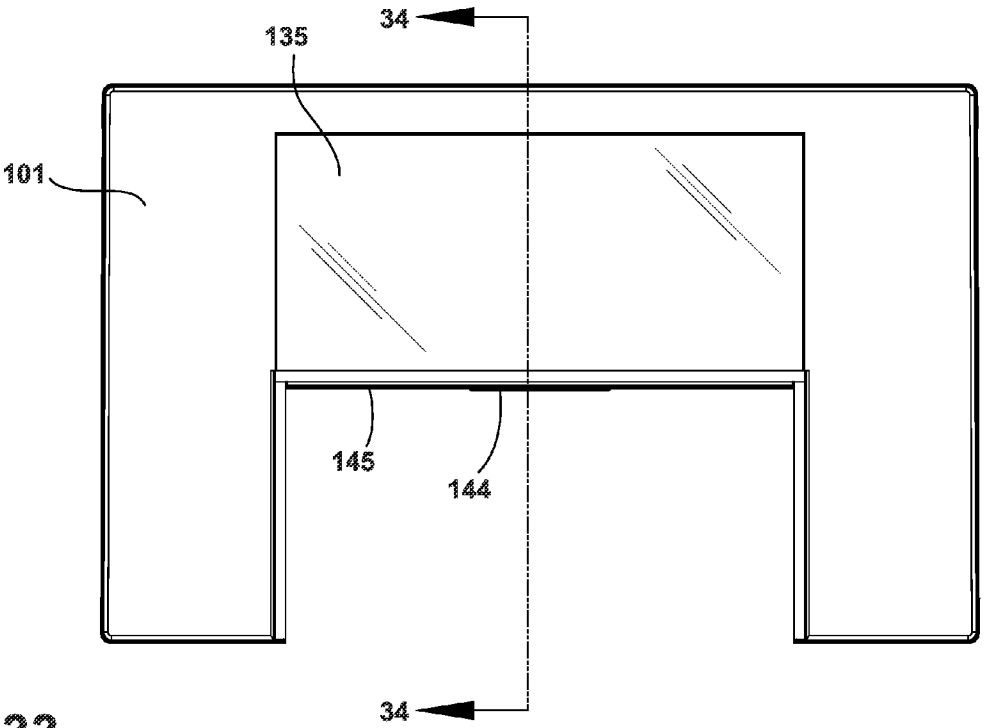
FIG. 33 is a top view of FIG. 32.

FIG. 33 is a plan view of FIG. 32.

Figure 34:
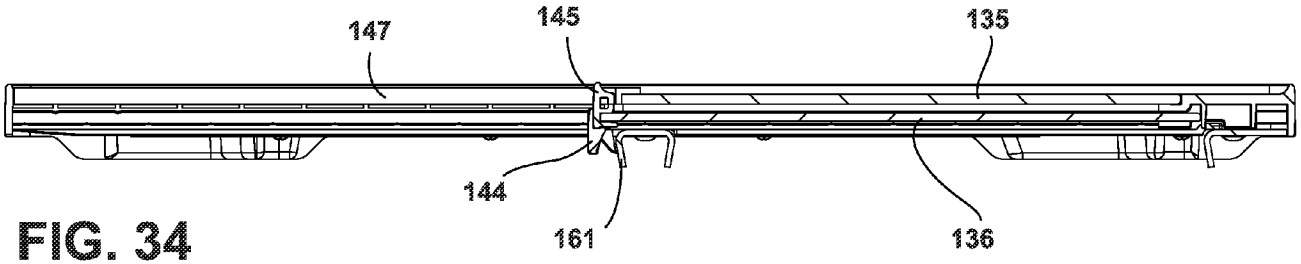
FIG. 34 is a cross-sectional view of FIG. 33 taken along lines 34-34 of FIG. 33.

FIG. 34 is a cross-sectional view of FIG. 33 taken along the lines 34-34 of FIG. 33. FIG. 34 shows U-shaped shelf 136 tucked under removable shelf 135 and shows the handle 145 and trim 144 up against an inverted U-shaped support piece 161 for the U-shaped shelf 101. Additionally illustrated is trim 147 that extends along the U-shape in the area from the front edge of the tuck shelf, when in a retracted position, not shown, and the front of the removable shelf 135. Accordingly, trim 147 extends from the front of the U-shaped shelf 101 towards the back of the U-shaped shelf but only extends as far as the trim 145 of the removable shelf 135.

In each case where trim is employed along the front of the tuck shelf, the trim itself may be constructed to extend above, below or above and below the shelf's top surface the shelf's bottom surface thereby providing a surface for the user the grasp and more the tuck shelf. A handle 144, for example, may also be used along with any sized trim and is typically positioned, when used, in the center of the tuck shelf to provide the user with the location to best apply force to the tuck shelf and provide greatest ease of movement by the user.

Figure 35:
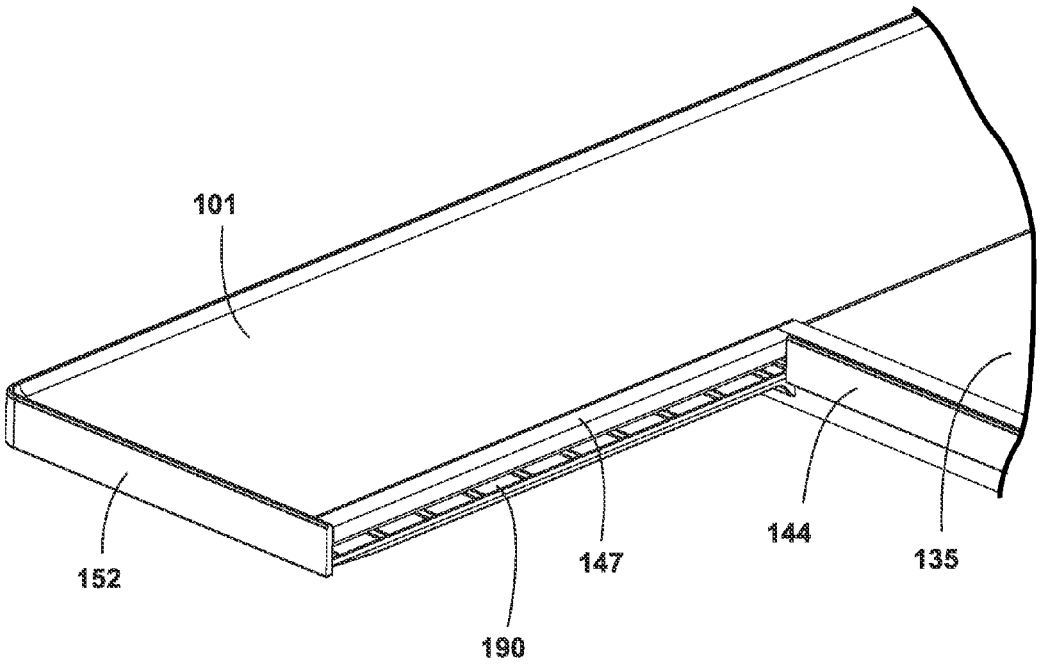
FIG. 35 is a perspective view of a lower left portion of the shelf of FIG. 33.

FIG. 35 is a perspective view of a portion of FIG. 33. FIG. 35 shows groove 190 in which the tuck shelf 136 slides.

Figure 36:
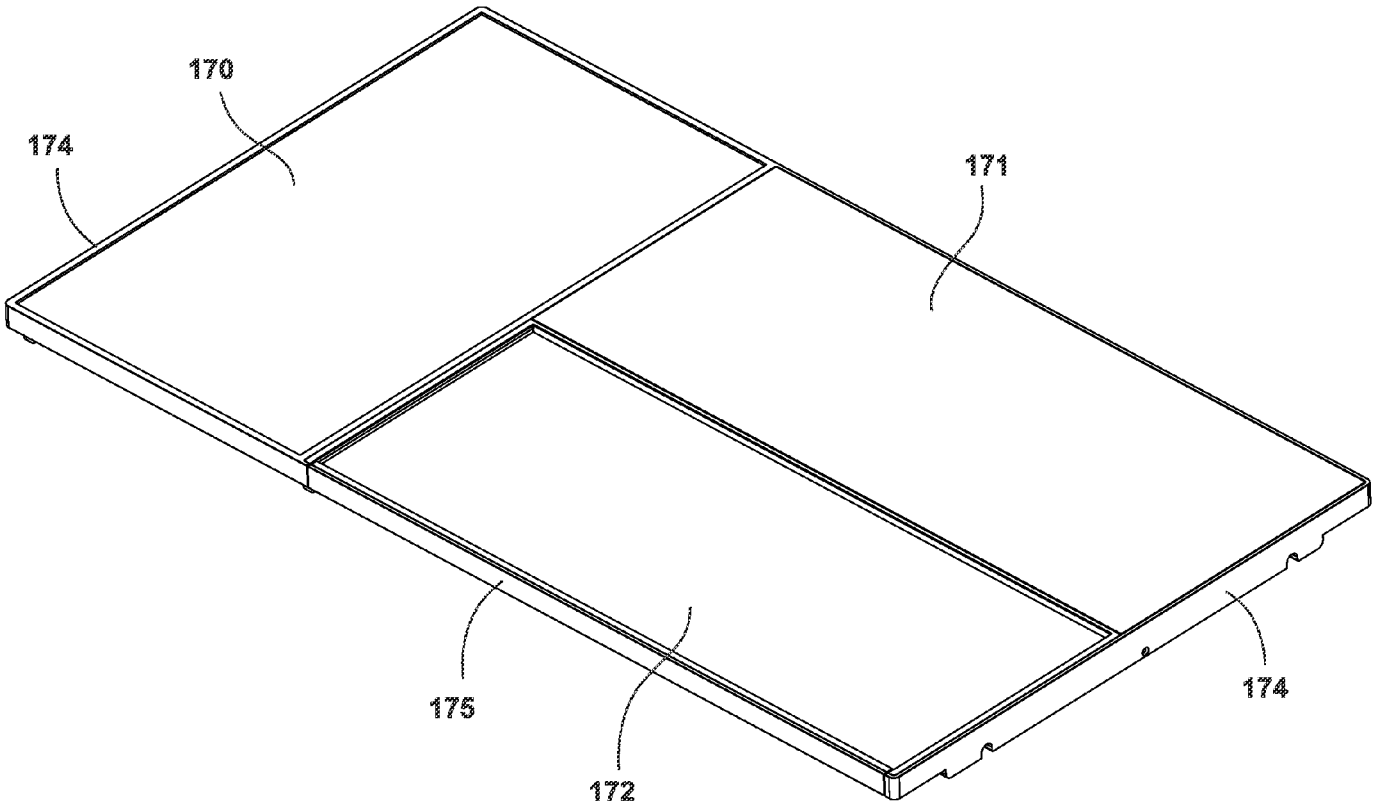
FIG. 36 is a perspective view of L-shaped shelf having a tuck shelf.

FIG. 36 is an alternate embodiment in which a shelf is made up of a shelf that is not a U-shape but rather an L-shaped shelf typically composed of two shelf portions 170, 171. First shelf portion 170 extends along the left side of the refrigerator cabinet, not shown, from the front of the cabinet towards the back of the cabinet. The second shelf 171 extends from the right most edge of the cabinet to a back, right edge of the shelf portion 170. Trim 174 is shown in this figure as going around the perimeter of shelf portions 170 and 171, as well as between shelf portions 170, 171. In addition, a tuck shelf 172 is provided, having trim 175 across a front portion of the tuck shelf. Tuck shelf 175 tucks under shelf portion 171, and with shelf portion 170, forms a generally rectangular shelf. Tuck shelf 172 will slide under at least a portion of the shelf portion 171. Typically, tuck shelf 172 and shelf portion 171 are sized so all of tuck shelf 172 may be received under shelf portion 171.

Figure 37:
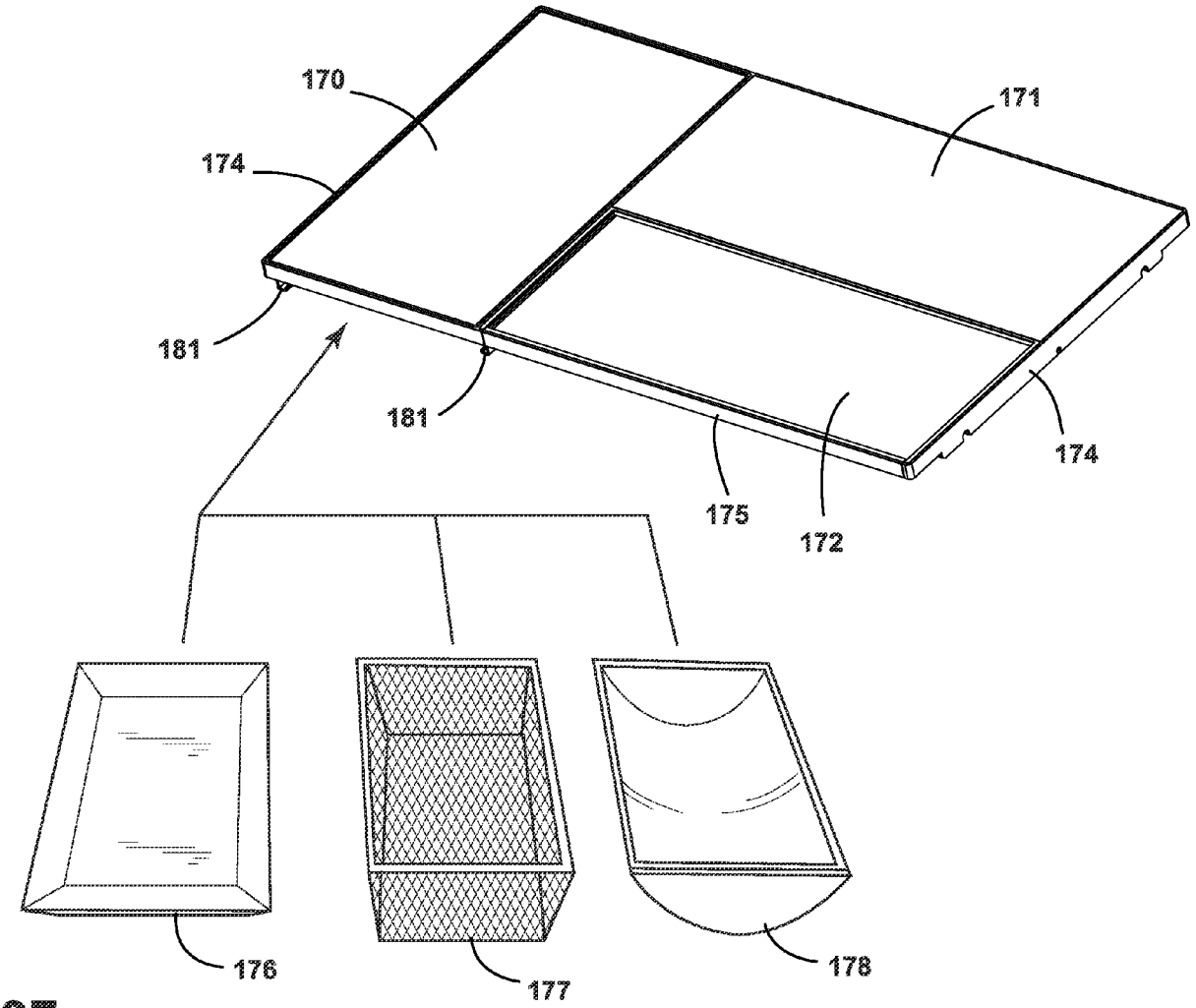
FIG. 37 is perspective view similar to FIG. 36 illustrating mounting brackets on the underside of the portion of the L-shaped shelf, and additional shelves are slidable into the mounting brackets and hung under the shelf.

FIG. 37 is similar to FIG. 36 with the exception that there are facing mounting brackets 181 mounted on the undersides of shelf portion 170. The mounting brackets have a downwardly extending portion and laterally extending portion defining a groove configured to support different inserts. Three types of inserts are specifically contemplated but the disclosure is not limited thereto. One insert is a deep pan 176. A second insert is a mesh insert 177. A third insert has a curved bottom 178. Any of the three inserts can be slid into support brackets 181 at the bottom of the shelf 170 to hang under the shelf. This could also be done in any of the other embodiments of this application as a substitution for a removable shelf or a tuck shelf or both, or under the solid left and/or right side portions of the shelves on the side of the removable shelf and tuck shelf.

Figure 38:
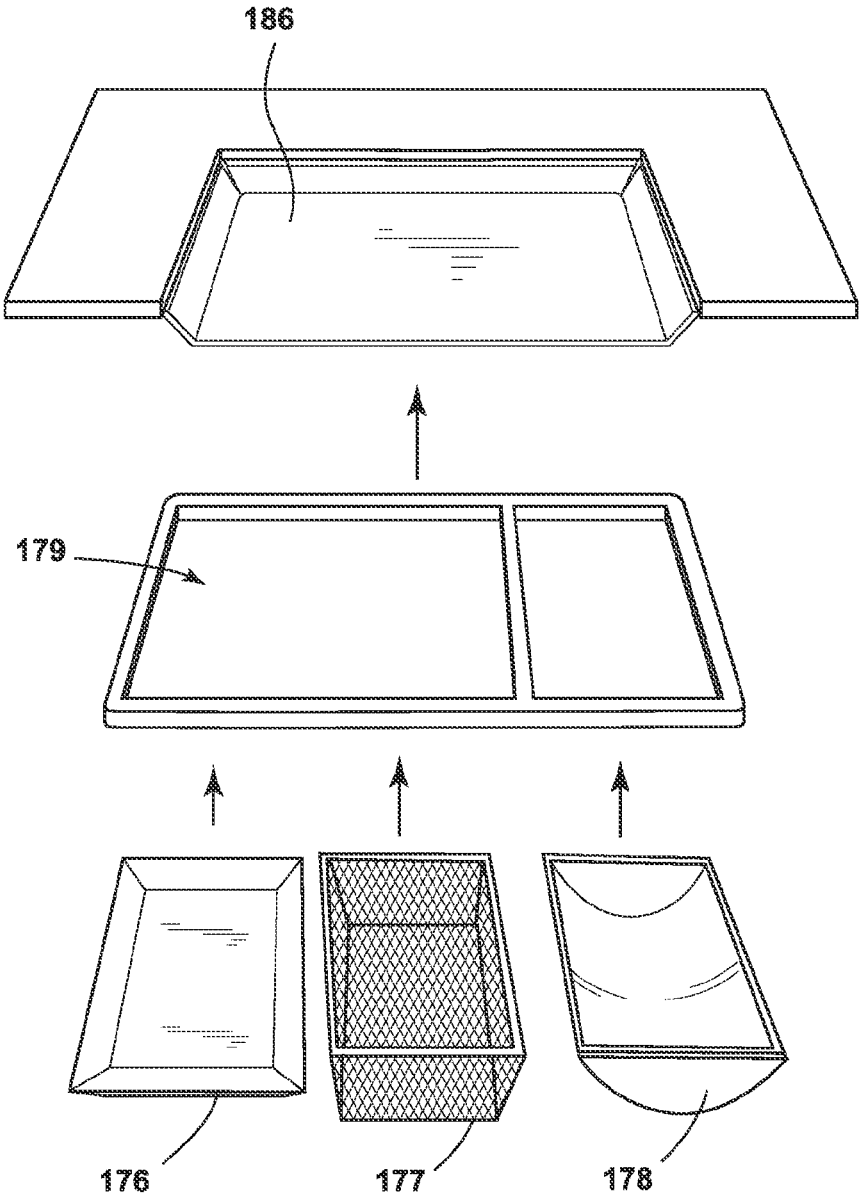
FIG. 38 is a perspective view of a single U-shaped shelf with alternate shelves that are receivable therein.

FIG. 38 is a similar view to FIG. 37 with the exception that a deep pan 186 is shown in the center of the U-shaped shelf. The deep pan 186 may be replaced with a two compartmental shelf 179 or the three insert shelves 176, 177 and 178. Alternatively, the three inserts 176-178 or various combinations of inserts could be placed on shelf 179 and placed into deep pan 186.

Figure 39:
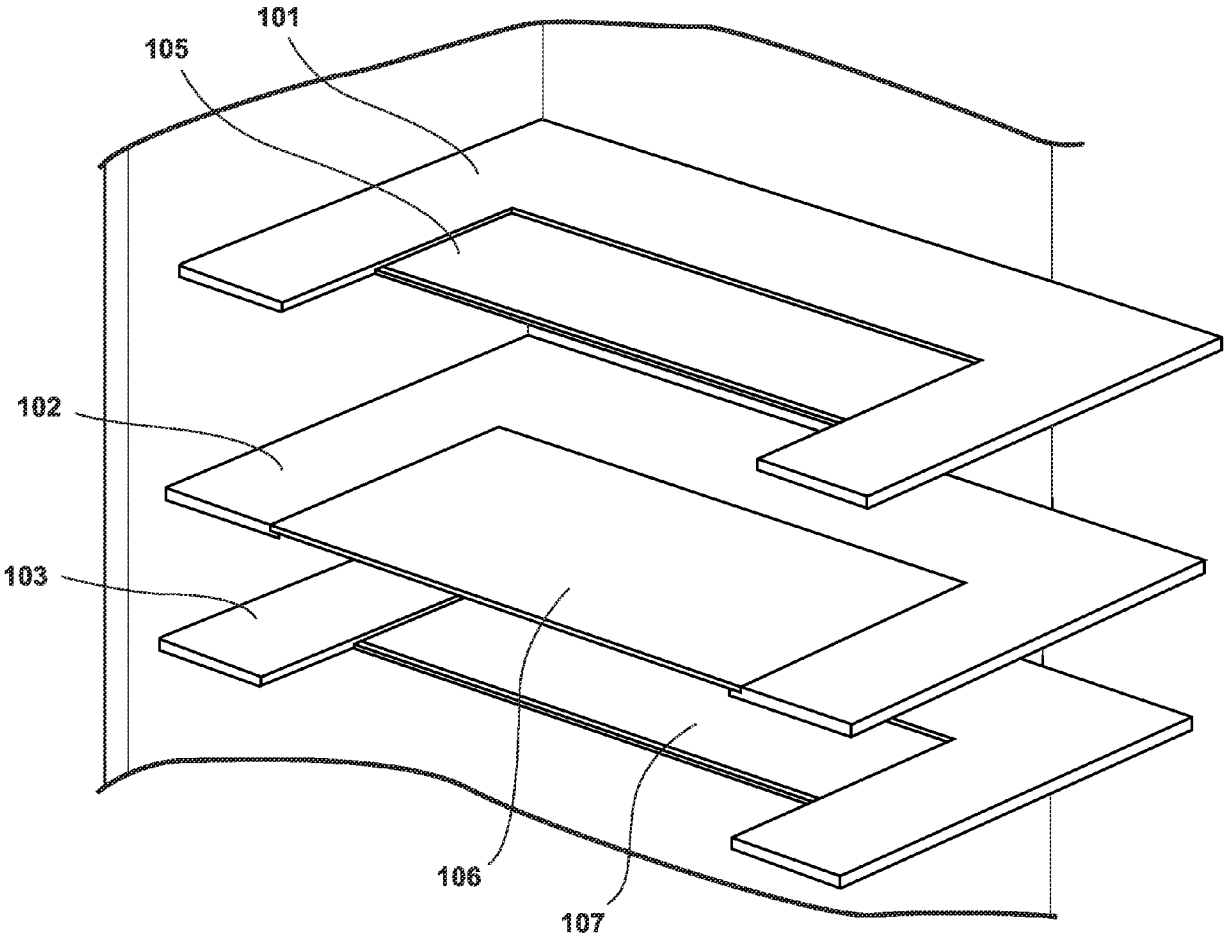
FIG. 39 is a perspective view of three U-shaped shelves within a cabinet of a FDBM refrigerator having removable or tuck shelves.

FIG. 39 is a perspective view showing three U-shaped shelves 101, 102, 103, as well as tuck shelf 105 within a top shelf 101 and a tuck shelf 107 within bottom U-shaped shelf 103. The middle U-shaped shelf 102 has a removable shelf 106 which is made of glass or a similar material, such as plastic, wood or a wood-look material. Removable shelf 106 sits on a ledge extending from the inside of the U-shape of the U-shaped shelf 101. The removable shelf 106 may be kept in place, lifted out of place or slid out of place to make room for items a taller and to be placed on a lower shelf.

Figure 40:
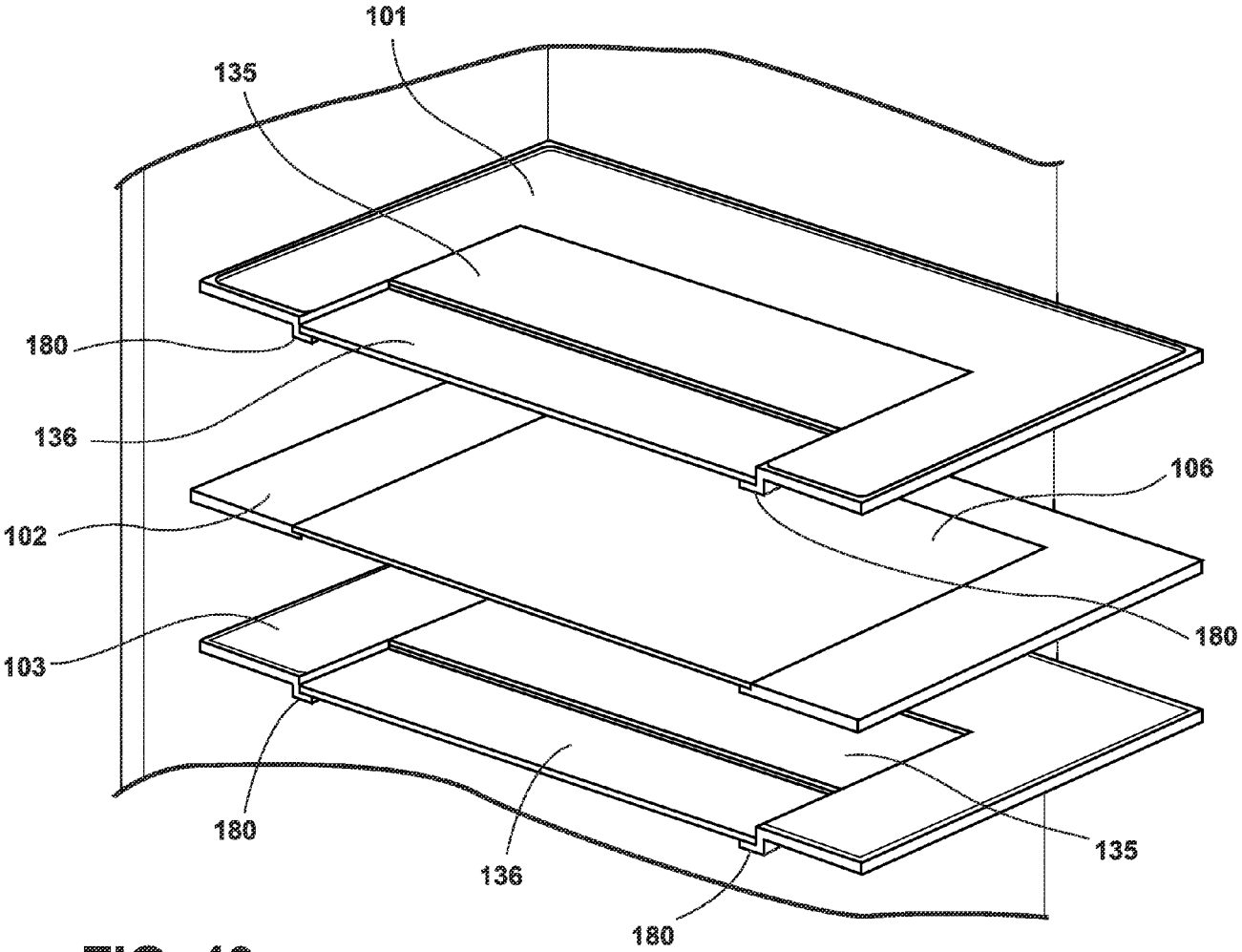
FIG. 40 is a perspective view in which some of the U-shaped shelves have internal ledges in the form of brackets for receiving removable shelves or tuck shelves, or both.

FIG. 40 is a perspective view similar to FIG. 39. In FIG. 40, the upper and lower U-shaped shelves have a ledge 180 in the form of brackets for receiving tuck shelf 136. In this exemplary embodiment, the ledge 180 is configured as downwardly and inwardly extending brackets 180 which receive the tuck shelf 136. The tuck shelf 136 can slide under removable shelf 135. Exemplary embodiments are not limited thereto and the brackets 180 could be provided for any or all of the U-shaped shelves in any exemplary embodiment. Similar, all of the U-shaped shelves may be provided with removable shelves 106 which can be lifted up or slid out of place.

Figure 41:
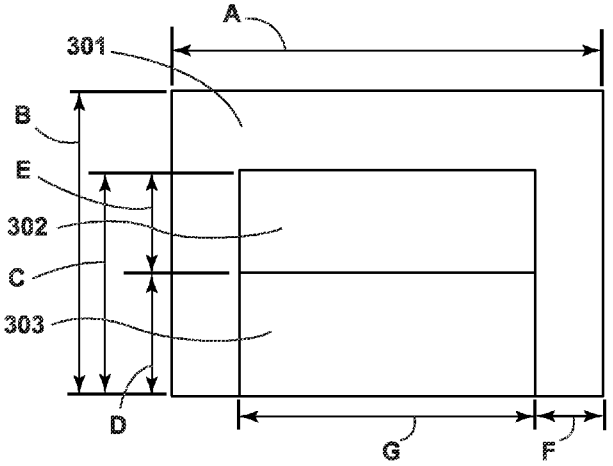
FIGS. 41-49 are plan view representations of different configurations of U-shaped shelves.

FIG. 41 is a representative view showing a U-shaped shelf having two glass shelves placed in the center of the U-shape structure 301 of the shelf. The glass shelf closest to the back of the U-shape is a removable shelf 302, and the glass shelf in the front of the U-shape is a tuck shelf 303, which may be tucked under the removable shelf 302 in a direction toward the back of the U-shapes shelf 301. The width of the solid side portion that are positioned on the side of the refrigerator compartment are typically from about 4 inches to about 7 inches wide and sufficiently sized to receive and hold on the shelf a container of a food or beverage such as a condiment, soda can or bottle, plastic container of food and the like. The full width "A" of the back of the U-shaped shelf, as illustrated, is 32 inches, but for a FDBM refrigerator can range from about 29 inches to about 34 inches. The depth of the back portion of the U-shape I, as illustrated, is 2 inches, but can vary from about 1 inch to about 7 inches. The full depth "B" of the U-shaped shelf, as illustrated, is 20.5 inches, but can vary from about 17 inches to about 22 inches, and for a counter depth refrigerator, from about 14 inches to about 17 inches. The depth of glass shelf 302, as illustrated by "E," is 9 inches, but can vary to between about 5 inches to about 13 inches. The depth of tuck shelf 303, as illustrated by "D" is 9.5 inches, but can vary between 5 inches to about 13 inches. The depth of the U-shaped opening "C" is 18.5 inches, as illustrated. The width "G" of the tuck shelf 303, as illustrated, is 18.7 inches but can vary between about 11 inches to about 23 inches. The width "F" of the right side portion of the U-shaped shelf, as illustrated, is 7 inches but can vary from about 4 inches to about 10 inches. A perimeter lip or food and beverage retention bar may be included around the interior of the U-shaped tuck shelf's side and back portions that surround any removable and/or tuck shelf portions. This will help retain the food about the perimeter despite any jostling of the food by, for example, a hard door closing or some movement of the appliance.

Figure 42:
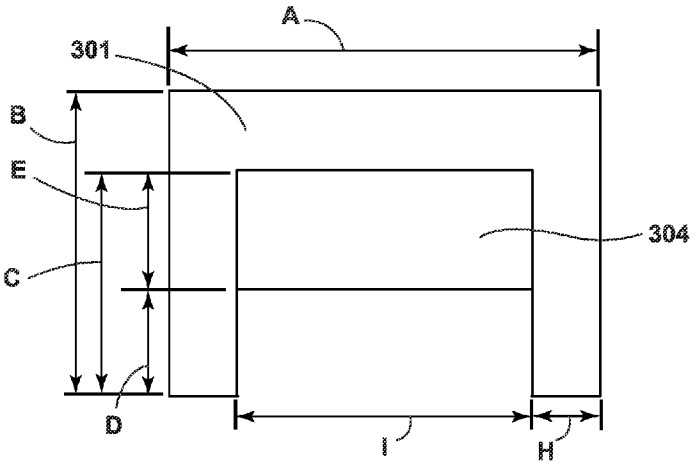

FIG. 42 is similar to the U-shaped shelf 301 of FIG. 41 with the exception that a single glass shelf is provided. The glass shelf 304 may be a tuck shelf or a removable shelf. The dimensions "A" through "C" for FIG. 42 is the same as for FIG. 41. The dimensions "E" and "I" for shelf 304 are the same as for shelf 302 in FIG. 41. The area below shelf 304 is open. The area "D" is open. The width "H" of the right side portion of the U-shaped shelf of FIG. 42 is the same as "F" of FIG. 41

Figure 43:
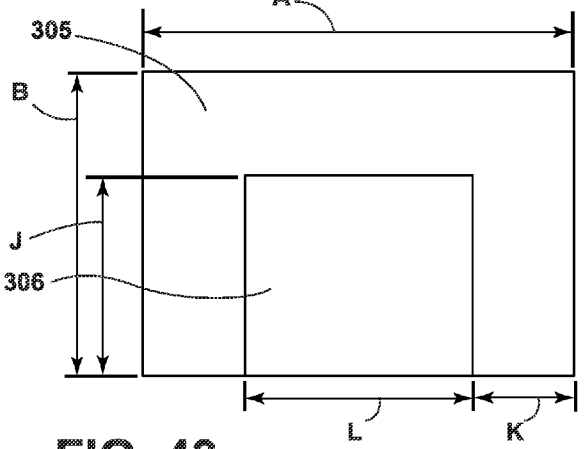

FIG. 43 shows a U-shaped shelf 305 having a thicker U-shape than FIG. 42. FIG. 43 illustrates a single removable shelf 306 which has a square shape and is smaller in width than shelf 304 of FIG. 42. In FIG. 43, the full width "A" of the U-shaped shelf, as illustrated, is the same as for FIG. 41. The full depth "B" of the U-shaped shelf, as illustrated, is the same as for FIG. 41. The full depth "J" of shelf 306 is between about 7 inches to about 15 inches. For a counter depth refrigerator, the full depth "J" of shelf 306 is between about 4 inches to about 10 inches. Depending on the dimensions of the shaped shelf 306, this piece of glass may not tuck under the back of the U-shape. In addition, the glass could be fixed, or no glass may be provided at all. The width "L" of the shelf 306 and the right side "K" of the U-shape are the same as the dimensions for FIG. 41.

Figure 44:
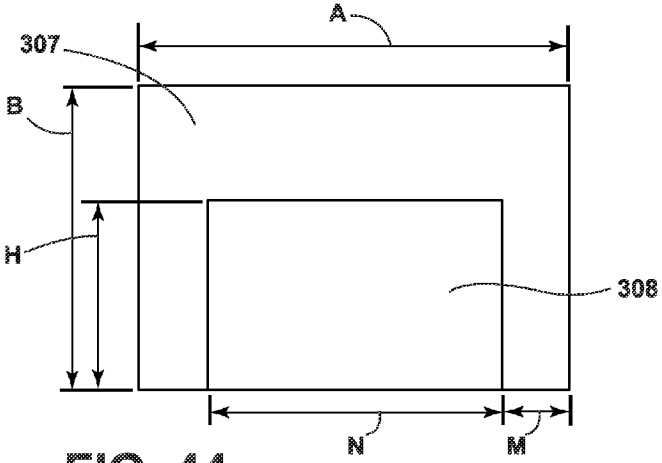

FIG. 44 shows a U-shaped shelf 307 with a deep back portion. A single removable shelf 308 is illustrated that is wider and narrower that removable shelf 306 of FIG. 43. In FIG. 44, the full shelf width "A" is the same as for FIG. 41. The depth "H" of the shelf 308 and the U-shaped shelf is the same as for FIG. 43. The width "N" of shelf 308 and the right side portion "N" of the U-shaped shelf is the same as for FIG. 41. The width "M" of the right side portion of the U-shaped shelf is the same as for FIG. 41.

Figure 45:
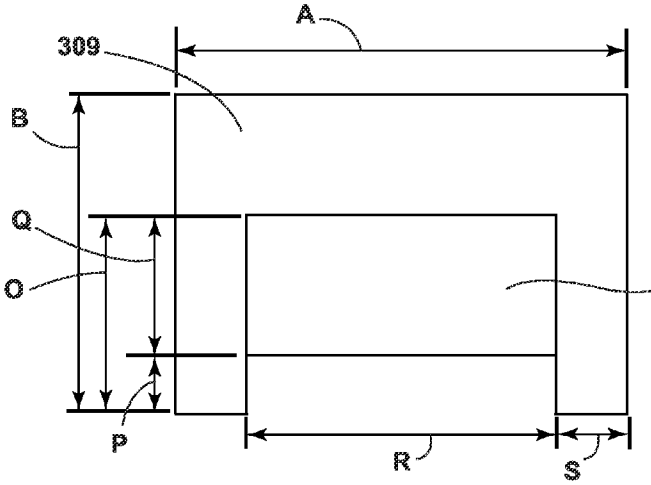

FIG. 45 shows a U-shaped shelf 309 having a deep back portion. A single shelf 312 is provided. However, the single shelf does not fill the opening in the U-shape and only fills approximately % of the opening in the U-shape of the U-shaped shelf. The dimensions for the full width "A" and the full depth and counter depth "B", is the same as for FIG. 41. The depth "Q" of the shelf 312 is in the range of about 9 inches to about 21 inches for a FDBM refrigerator and between about 6 inches to about 16 inches for a counter depth refrigerator, respectively. The depth "O" of the opening in the U-shaped shelf is in the range of about 9 inches to about 21 inches for a FDBM and in the range of about 6 inches to about 16 inches for a counter depth refrigerator. The depth of the open space between shelf 312 and the front of the U-shaped shelf is between zero inches to about 9 inches for a FDBM refrigerator and from zero to about 6 inches for a counter depth refrigerator. The width "R" of shelf 312 and the width "S" of the right side portion of the U-shaped shelf are the same as widths "N" and "M" in FIG. 44.

Figure 46:
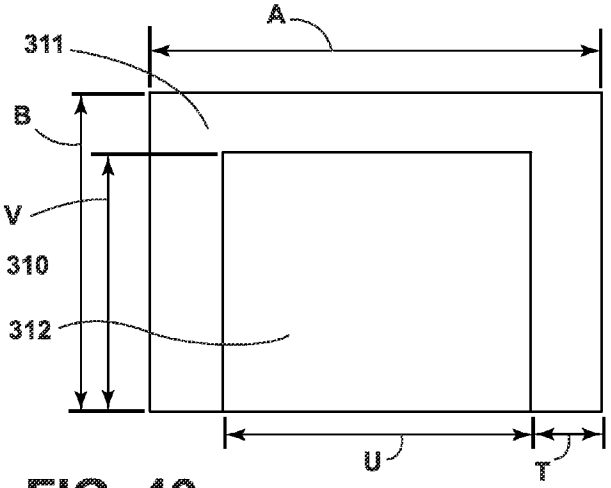

FIG. 46 is an exemplary embodiment of a U-shaped shelf 311 having a 5 inch thick back portion and a removable glass 310 that fills % of the depth of the U-shape. The removable shelf may be left in place, removed or lifted up and slid out of position. In addition, removable shelf 106 could either be glass, plastic, wood, or may have a wood-look. In FIG. 46, the full width "A" of the U-shaped shelf is the same as for FIG. 41. The full depth "B" and counter depth are the same as for FIG. 41. The depth of the back portion 311 of the U-shape is between about 4 inches to about 14 inches (unlabeled, but is equal to "B" minus "O")." The depth "Q" of shelf 310 is between about 10 inches to about 18 inches. The width "U" of the open portion 310 is the same as the width of shelf "N" in FIG. 42. The width "T" of the right side of the U-shaped shelf portion is, as illustrated, 7 inches, but may vary between about 4 inches to about 10 inches.

Figure 47:
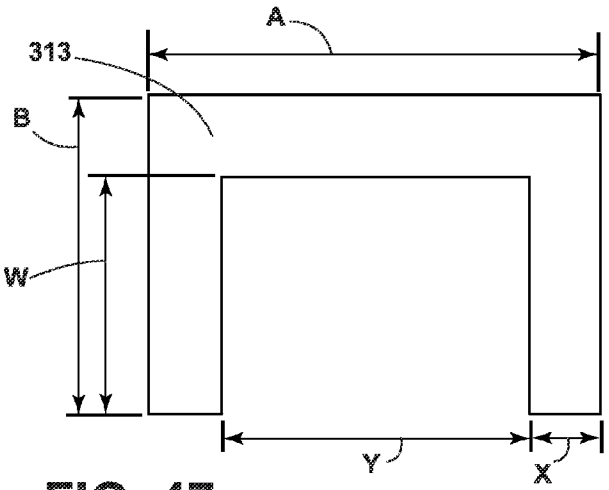

FIG. 47 shows a U-shaped shelf 313 that has no glass shelf and a 5 inch thick back portion of the U-shape. However, the depth (unlabeled but equal to "B" minus "W") of the back portion may vary from about 4 inches to about 14 inches. The full width "A" of the U-shaped shelf is the same as for FIG. 41. The full depth "B" for an FDBM refrigerator and for a counter depth refrigerator is the same as for FIG. 41. The depth "W" of the U-shaped opening is about 10 inches to about 18 inches. The widths "Y" and "X" of the opening of the U-shaped shelf 313 and the width of the right side portion of the U-shape are the same and the widths "N" and "M" of FIG. 44.

Figure 48:
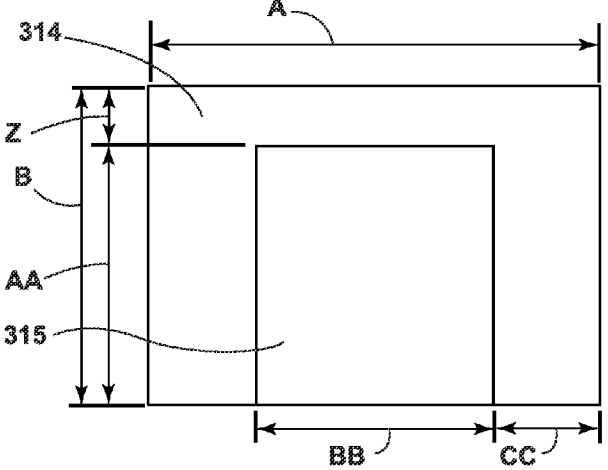

FIG. 48 shows a U-shaped shelf 314 having a narrower back portion than the back of the U-shaped shelf of FIG. 47. A removable shelf 315 is provided that is narrower in width than the removable shelf of FIG. 46. The full width "A" of the U-shaped shelf is the same as for FIG. 41 The full depth and counter depth "B" is the same as for FIG. 41. The depth "Z" is equal to "B" minus "AA." The depth "AA" of shelf 315 is the same as for FIG. 46. The widths "BB" and "CC" of the shelf 315 and the right side portion of the U-shaped shelf 314 may be the same as for FIG. 41 or 43.

Figure 49:
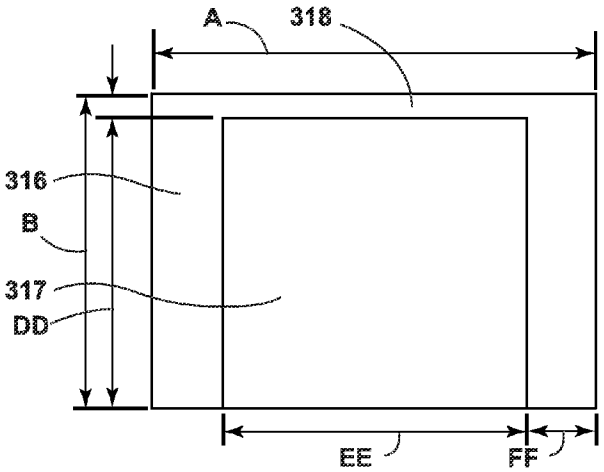

FIG. 49 is an exemplary embodiment that is similar to FIG. 48 but has a super narrow back 318 in U-shaped shelf 316. However, there is still sufficient space in the back of the U-shape 318 for holding items that would normally be in a refrigerator. A removable shelf 317 is also provided. The full width "A" of the U-shaped shelf is the same as for FIG. 41. The full depth "B" is the same as for FIG. 41. The depth "DD" of shelf 317 may be about 9 inches to about 21 inches for a FDBM and about 6 inches to about 16 inches for a counter depth refrigerator. The width "EE" of shelf 317 may be the same as for FIGS. 41 and 43. The width "FF" of the right side portion of the U-shaped shelf is the same as width "F" of FIG. 41.

Figure 50:
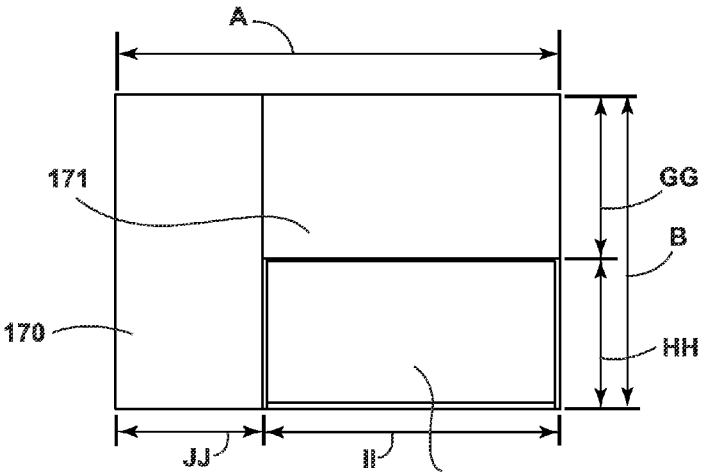
FIGS. 50 and 51 are plan view representations of L-shaped shelves incorporating the tuck shelf according to an aspect of the present disclosure.

FIG. 50 is an exemplary embodiment with two shelf portions in which one shelf portion 170 extends along the left side, front to back, of the refrigerator cabinet and the other shelf portion 171 extends from the back right edge of shelf portion 170 to the right edge of the refrigerator cabinet. A tuck shelf 172 tucks under the shelf portion 171, and the tuck shelf 172 and the shelf portions 170 and 171 generally form a rectangle that fills the refrigerator cabinet. The full width "A" is about 32 inches. For a FDBM, the width "A" is between about 29 inches to about 34 inches. For a side-by-side refrigerator, the width "A" is about 18 inches. The width "II" is between about 7 inches to 16 inches, and for a side-by-side refrigerator is about 4 inches to about 8 inches. The width "JJ" of shelf portion 172 is between about 16 inches to about 25 inches. For a counter depth refrigerator, the width is about 10 inches to about 14 inches. The full depth "B" is the same as for FIG. 41. The depth "GG" is about 10 inches to about 16 inches for a FDBM and about 7 inches to about 10 inches for a counter depth refrigerator. The depth of "HH" is about 6 inches to about 11 inches for a FDBM and about 5 inches to about 8 inches for a counter depth refrigerator.

Figure 51:
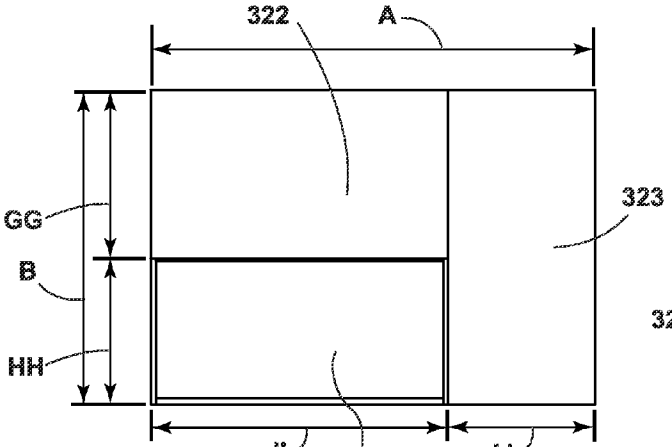

FIG. 51 is a mirror image of the shelf structure of FIG. 50. As a result, the dimensions "A", "B", "GG", "HH", "JJ" and "II" are the same as for FIG. 50.

The overall width of the U-shaped shelf is typically about 29 inches to about 34 inches for a FDBM and about 18 inches for a side-by-side refrigerator in each of FIGS. 41-49. Additionally, the overall depth is typically between from about 17 inches to about 22 inches and about 14 inches to 17 inches for a counter depth refrigerator. For a side-by-side refrigerator, the full depth is about 18 inches.

Figure 52:
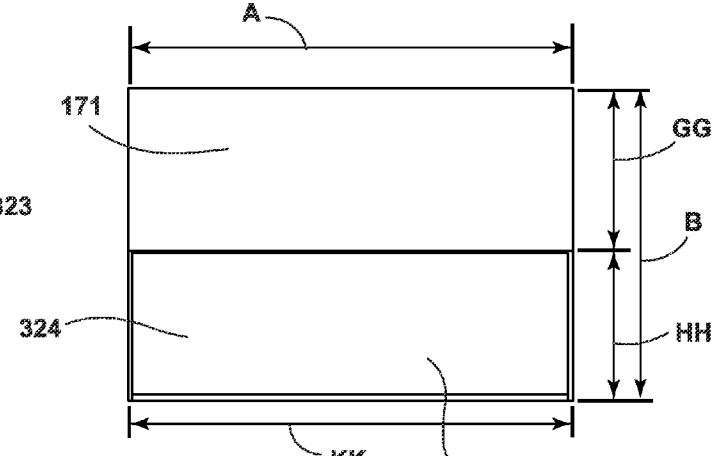
FIG. 52 is a plan view of the tuck shelf spanning the width of the shelf which spans the width of the refrigerator compartment.

FIG. 52 is an exemplary embodiment with the tuck shelf extended across the entire width or substantially the entire width of the shelf with side supports and the shelf width together spanning the width of the refrigerator compartment interior.

Figure 53:
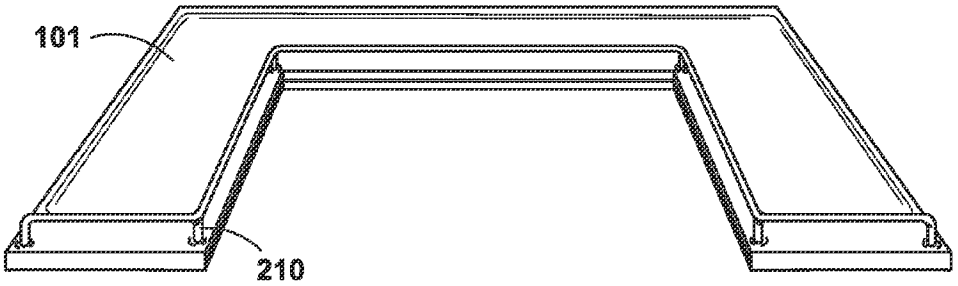
FIG. 53 is a perspective view of a U-shaped shelf having a raised rail.

FIG. 53 is an exemplary embodiment showing a short rail 210 on the U-shaped shelf 101. This short rail ensures that an item that is on the shelf does not easily tip over off of the shelf.

Figure 54:
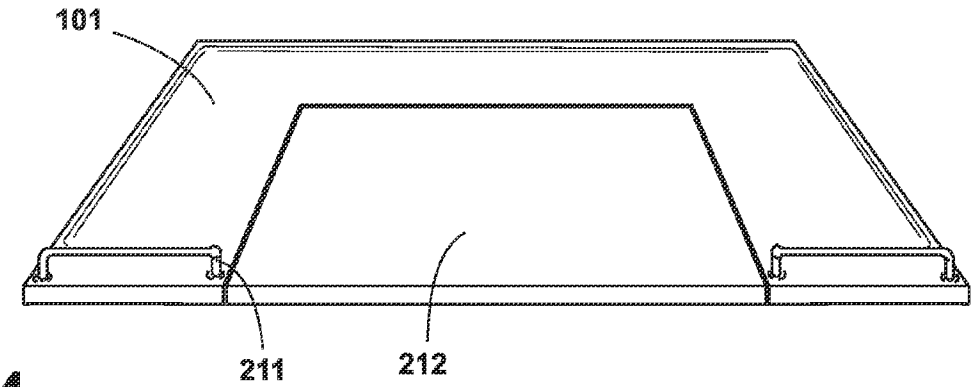
FIG. 54 is a perspective view of a U-shaped shelf having a solid removable shelf therein.

FIG. 54 illustrates a U-shaped shelf 101 having a short rail 210 which only extends along the front edge of the top of the U-shape. A solid removable shelf 212 of plastic, glass or wood-look material fills the U-shape of the U-shaped shelf. A raised edge, unnumbered, surrounds the rest of the U-shaped shelf to help prevent spills from going over tan edge of the U-shaped shelf.

Figure 55:
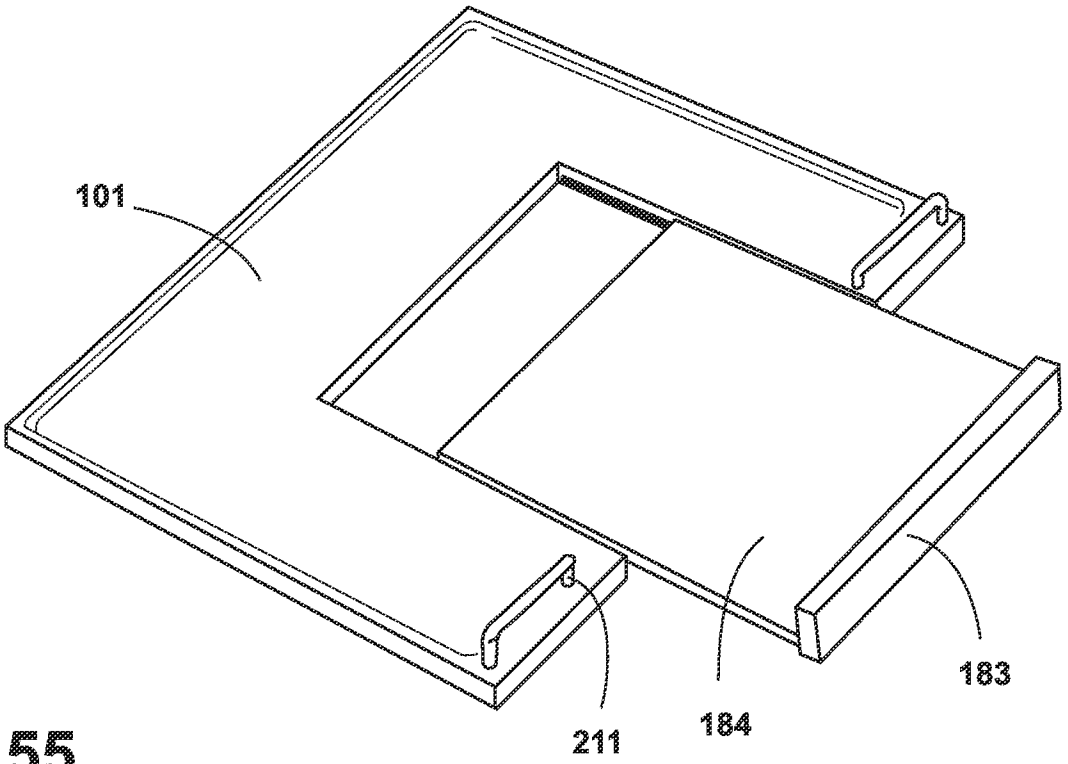
FIG. 55 is a perspective view of a U-shaped shelf having a solid removable shelf therein with a different rail placement than FIG. 54.

FIG. 55 is a representation of a U-shape shelf 101 that has a ledge around three sides of the U-shape. On the top of the U-shape is a short rail 211. In addition, a solid shelf 184 fills the U-shape. The removable shelf 184 has a front trim with a raised top that acts to help prevent items near the front of the removable shelf from tipping over. In addition, the outer perimeter of the sides and back of the U-shaped shelf has a raised edge to prevent spillage.

Figure 56:
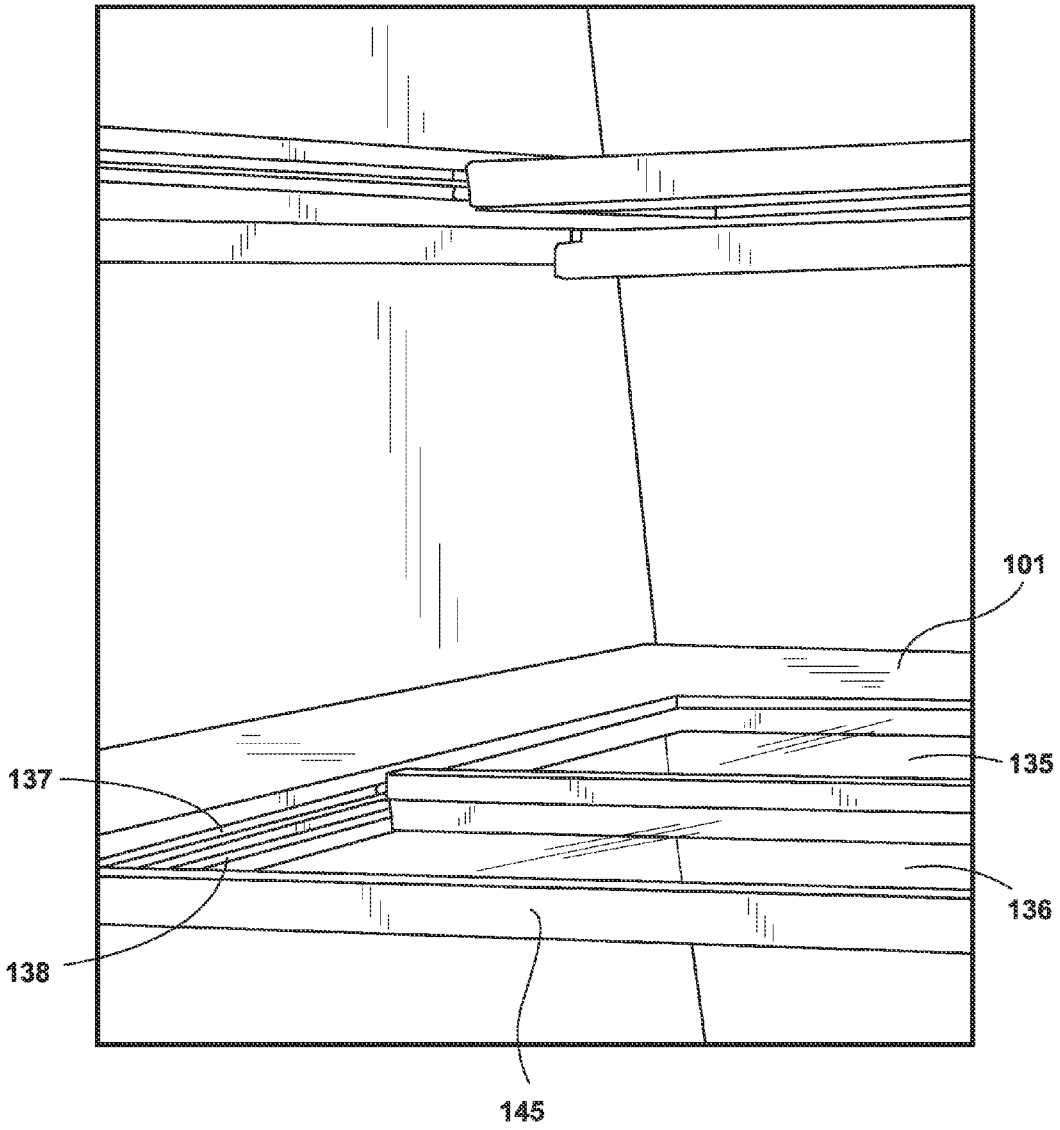
FIG. 56 is a perspective view of the inside of a FDBM refrigerator cabinet having removable shelves and tuck shelves.

FIG. 56 is a perspective view of the inside of a refrigerator cabinet showing two shelves that slide into grooves in a U-shaped shelf structure 102. The bottom shelf inserted into the U-shape is a tuck shelf 136 which slides horizontally under an upper shelf 135, which is typically a removable shelf. Trim 145 is on the front of glass shelf 136 and grooves 137 and 138 are also illustrated.

Figure 57:
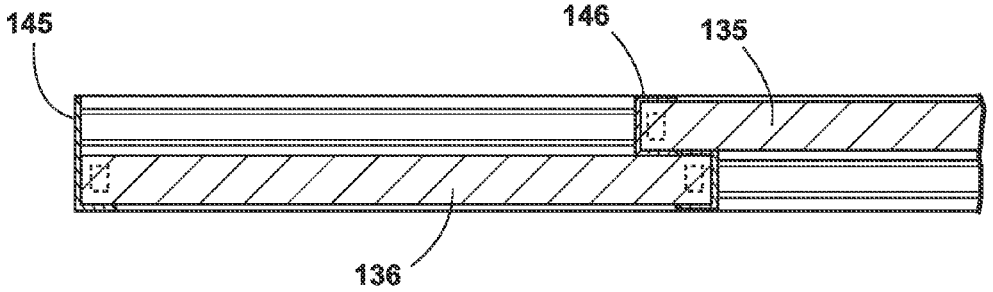
FIG. 57 is a side view of FIG. 56 showing the tuck shelf pulled and retracted behind the removable shelf.

FIG. 57 is a side view of FIG. 56 showing the tuck shelf 136 in a retracted position and below removable shelf 135. Additionally shown is front trim 146 of removable shelf 135 and also an enlarged trim 145 which brings up the top of the trim to the height of the top of the removable glass shelf 135.

Figure 58:
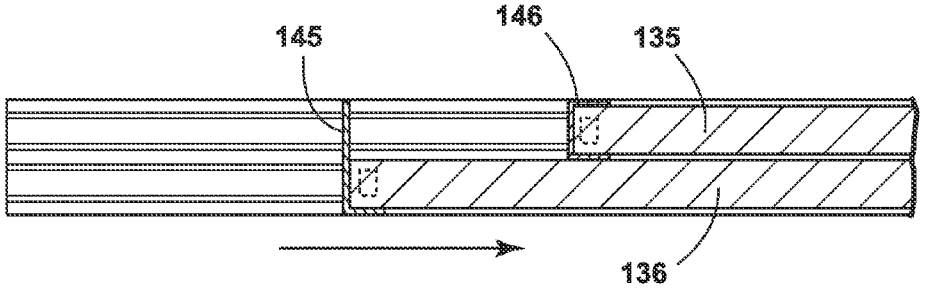
FIG. 58 shows the tuck shelf of FIG. 56 tucked in halfway and partially under the removable glass shelf.

FIG. 58 is a similar view to FIG. 57 but shows the glass shelf 136 slid half way into a retracted or tucked position under removable shelf 135.

Figure 59:
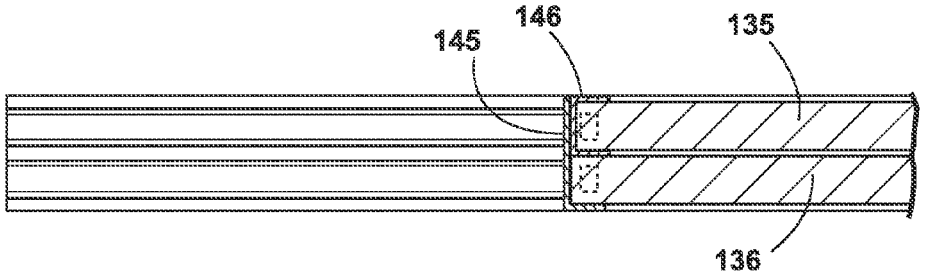
FIG. 59 shows the tuck shelf of FIG. 56 fully tucked under the removable shelf.

FIG. 59 is similar but shows lower tuck shelf 136 slid fully into position under removable shelf 135.

Figure 60:
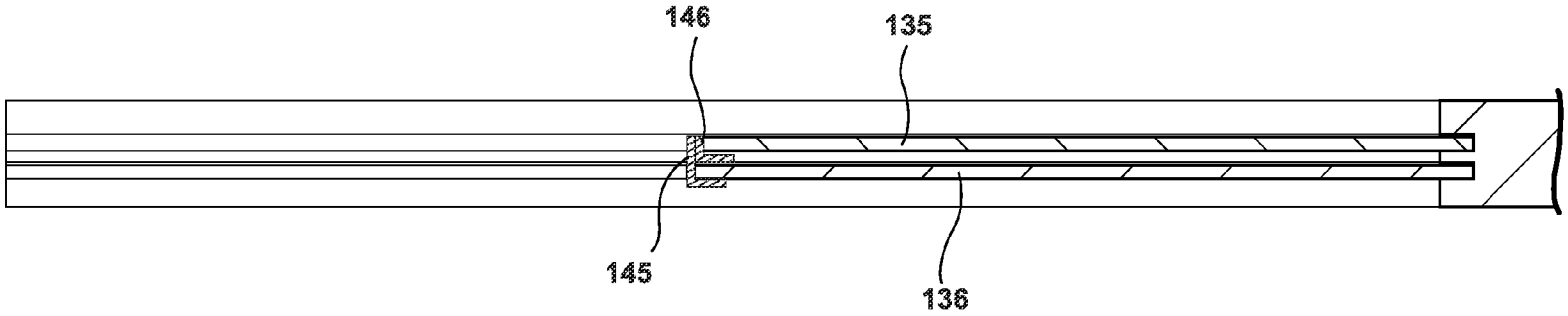
FIG. 60 is a view similar to FIG. 59 but shows an alternate structure of the trim of the tuck shelf.

FIG. 60 is an exemplary embodiment showing a different trim member 145 for the front of the lower glass tuck shelf 136.

Figure 61:
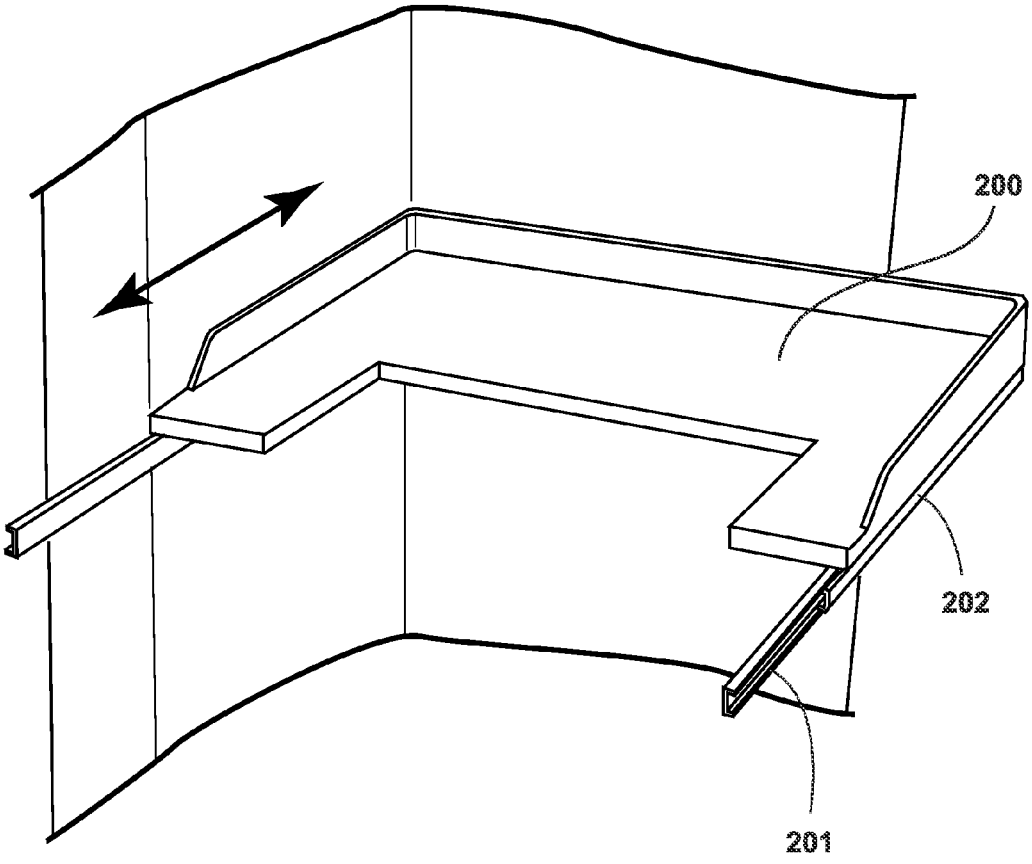
FIG. 61 shows a U-shaped shelf mounted on brackets for sliding in and out of the cabinet of a refrigerator.

FIG. 61 is an exemplary embodiment of a U-shaped shelf 200 which is slidable in and out of position by a slide mechanism 201 which is attached to a corresponding slide mechanism 202 formed on the U-shaped shelf 200.

Figure 62:
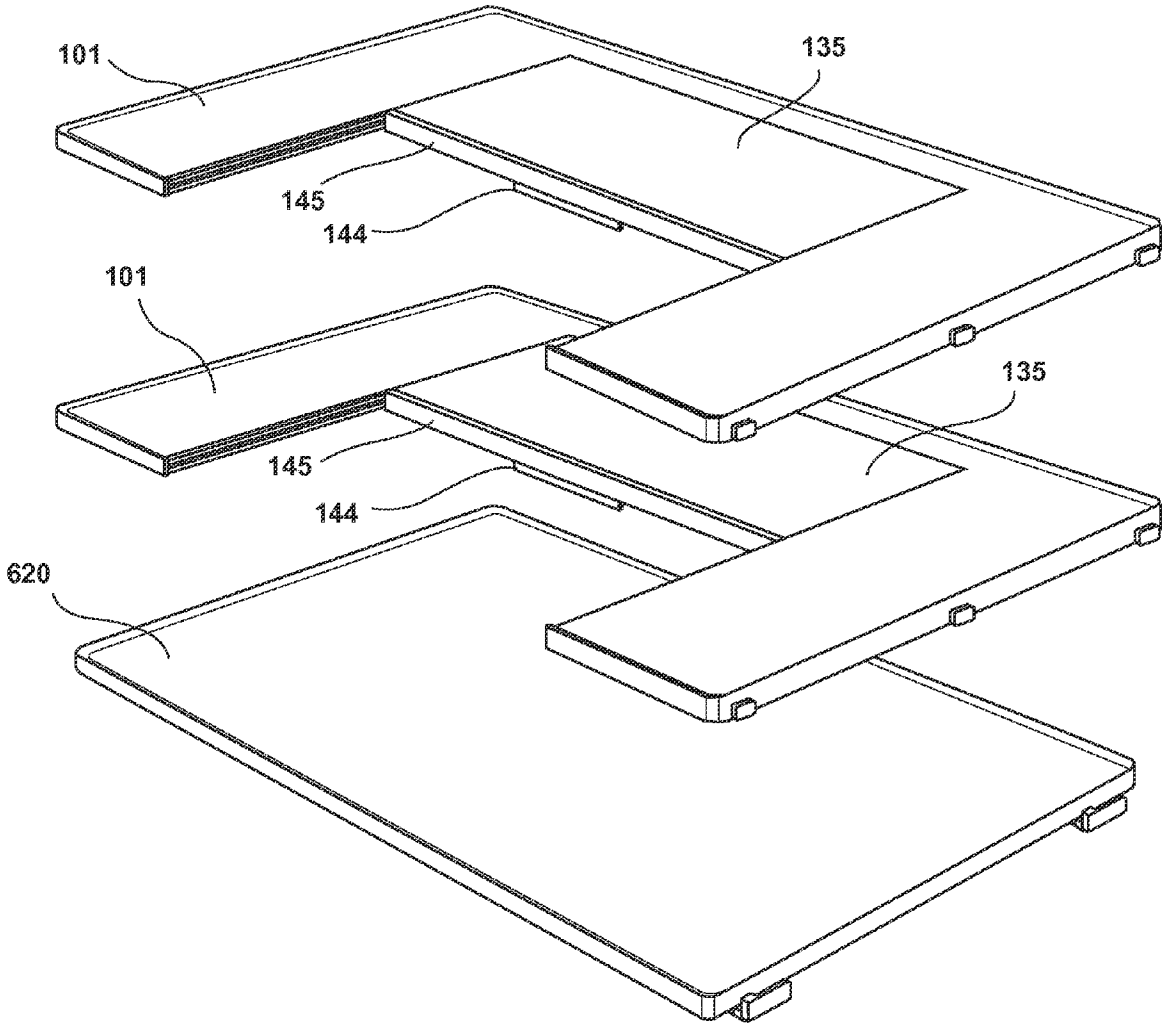
FIG. 62 shows an embodiment of a refrigerator having a full shelf; a tuck shelf within a U-shaped shelf and a half shelf.

FIG. 62 is an exemplary embodiment of a refrigerator having a full shelf and two tuck shelves within U-shaped shelves. In FIG. 62, the full shelf is 620. In this figure, the full shelf is located below two upper shelves. Each of these upper shelves, as indicated in this figure, is a U-shaped shelve 101 each with a tuck shelf 135 therein. As displayed in the figure, the tuck shelves are centered. However, the tuck shelves may be offset from the center of the shelf or may be located at one end of the shelf. The front trim on each tuck shelf is 144 and the pull handle portion for each tuck shelf trim portion is 145.

Figure 63:
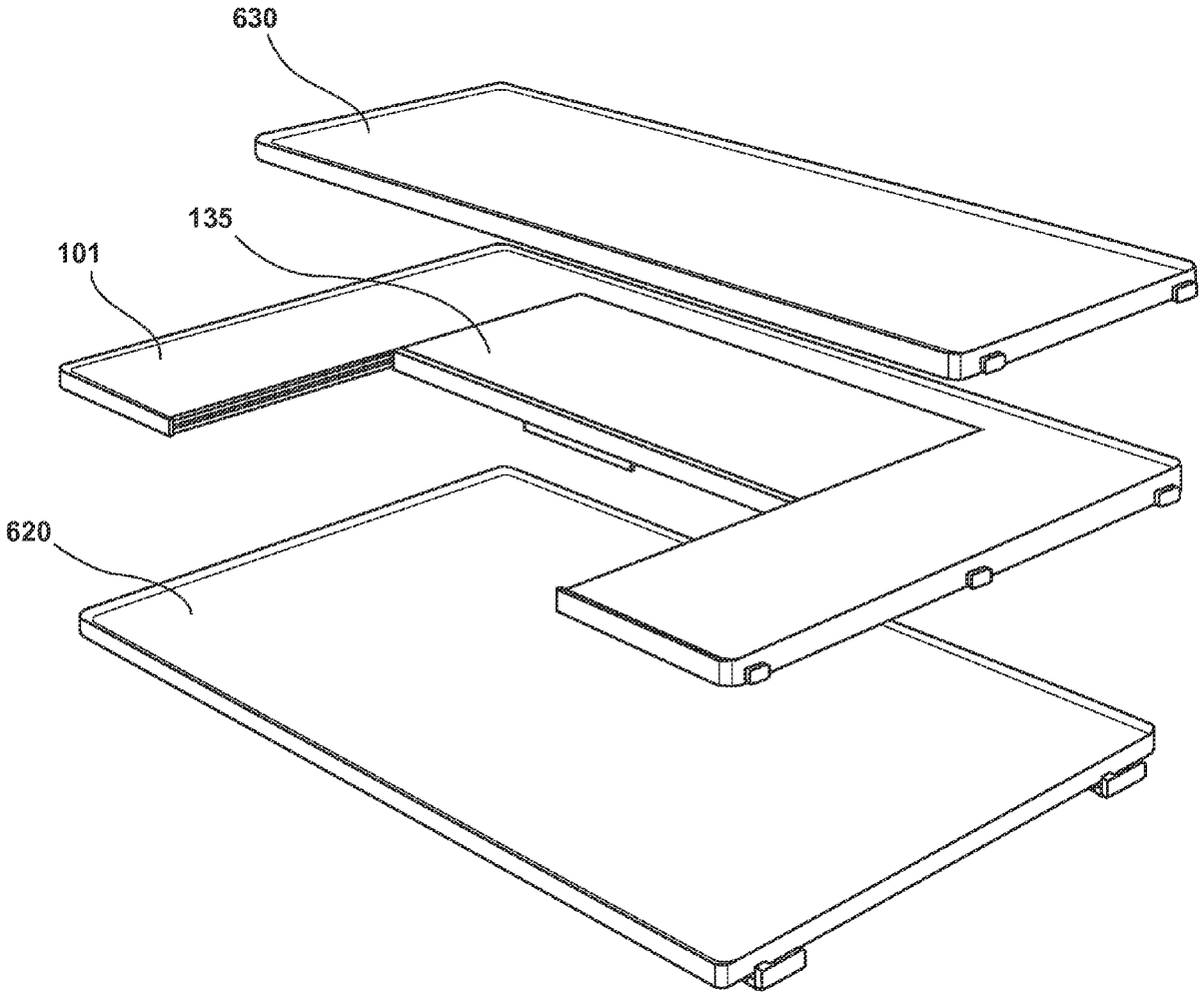
FIG. 63 shows an embodiment of a refrigerator with a full shelf and two tuck shelves within U-shaped shelves.

FIG. 63 is an exemplary embodiment of a refrigerator having a full shelf, a tuck shelf within a U-shaped shelf and a half shelf. In this figure, there is a full shelf 620 as the lowermost shelf, U-shaped self 101 with tuck shelf 135 is the middle shelf and half shelf 630 is illustrated as the uppermost of the three shelves.

Figure 64:
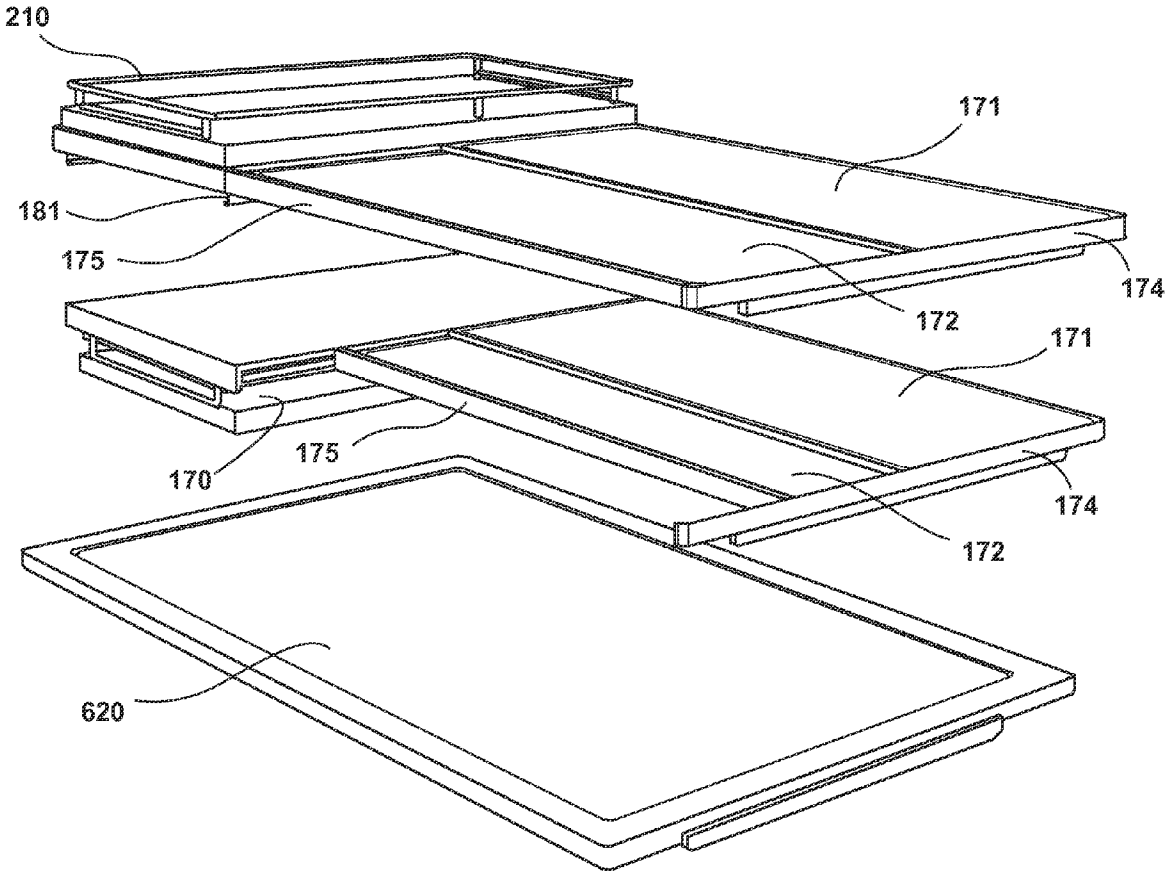

FIG. 64 is an exemplary embodiment id a refrigerator having a full shelf and a two tuck shelves, wherein each of the tuck shelves is offset from the center of the shelf it is in. As shown in this figure, the lowest of the three shelves is full shelf 620. The middle shelf is made up of a shelf portion 170 on the left side with a top portion. To the right of the left shelf 170 is a rear shelf portion 171 and a tuck shelf 172 which slides under shelf portion 171. At the front of tuck shelf 172 is a trim portion 175. A trim portion on the right side of the middle shelf is 174. In this figure, the upper shelf has a railing 210 around the left shelf portion to keep food from falling of the shelf. A bracket 181 is also illustrated.

In FIGS. 62-64, particular orientations and types of shelves are illustrated. However, this is merely exemplary in nature. Any of the shelves shown in the specification, and equivalents thereof, can be used, in any number and in any configuration and orientation.

The disclosed embodiments described above are merely exemplary in nature and should be construed as limiting the invention in any manner. Rather, the invention is defined by the appended claims.

The invention claimed is:

1. A U-shaped shelf for a refrigerator cabinet comprising:

a left side portion extending at least substantially along a left side of the refrigerator cabinet from a back of the cabinet towards a front of the cabinet which faces a user;

a right side portion extending at least substantially along a right side of the refrigerator cabinet from the back of the cabinet towards the front of the cabinet which faces a user;

a back portion extending between the left and right side portions, wherein the left, right and back portions define a center portion and form a U-shaped shelf within the refrigerator cabinet;

a center shelf within the center portion of the U-shaped shelf, wherein the center shelf at least partially fills the center portion of the U-shaped shelf between the left and right side portions and abuts or nearly abuts the back portion of the U-shaped shelf; and the U-shaped shelf is integrally formed as a single shelf and sized to extend across a width of an interior of the refrigerator cabinet and further comprises a center tuck shelf moveable between a retracted position under the center shelf and an extended position where at least a portion of the tuck shelf extends beyond a front edge of the center shelf;

wherein the left side, right side and back portion are sized and configured to retain containers of food or beverage and the left side portion and the right side portion have a width of at least about four inches; and the center shelf is a removable shelf made from glass, plastic, wood, or a wood-look material and the tuck shelf extends to a fully extended position that at least substantially aligns with a front of the left side portion and a front of the right side portion and wherein the tuck shelf, when extended, does not abut the front edge of the center shelf and is not in the same plane, but is a parallel plane.

2. A U-shaped shelf for a refrigerator cabinet comprising:

a left side portion extending at least substantially along a left side of the refrigerator cabinet from a back of the cabinet towards a front of the cabinet which faces a user;

a right side portion extending at least substantially along a right side of the refrigerator cabinet from the back of the cabinet towards the front of the cabinet which faces a user;

a back portion extending between the left and right side portions, wherein the left, right and back portions define a center portion and form a U-shaped shelf within the refrigerator cabinet;

a center shelf within the center portion of the U-shaped shelf; and a tuck shelf which is configured to at least partially tuck under the back portion of the U-shaped shelf in a horizontal direction;

wherein the left side, right side and back portion are sized and configured to retain containers of food or beverage, the left side portion and the right side portion have a width of at least about four inches, and the center shelf at least partially fills the center portion of the U-shaped shelf between the left and right side portions and abuts or nearly abuts the back portion of the U-shaped shelf.

3. The U-shaped shelf for a refrigerator cabinet of claim 2, wherein the center shelf is a removable shelf configured to be lifted up or slid out of the refrigerator cabinet.

4. The U-shaped shelf for a refrigerator cabinet of claim 2, wherein the U-shaped shelf includes a ledge extending inwardly towards a center of the cabinet, wherein the ledge supports the center shelf.

5. The U-shaped shelf for a refrigerator cabinet of claim 4, wherein the center shelf fills the center portion of the U-shaped shelf between the left, right and back portions.

6. The U-shaped shelf for a refrigerator cabinet of claim 2, wherein a tuck shelf is located between the center shelf and the front of the U-shaped shelf, wherein the center shelf is a removable shelf and the tuck shelf is configured to slide under the removable shelf.

7. The U-shaped shelf for a refrigerator cabinet of claim 2, further comprising an upwardly extending ledge around at least a portion the perimeter of the U-shaped shelf.

8. The U-shaped shelf for the refrigerator cabinet of claim 7, wherein the upwardly extending ledge is configured to be about the perimeter of the U-shaped shelf with the exception of the location of the center shelf and the center shelf is a removable shelf, and wherein the removable shelf has a trim portion facing the left and right side portions, wherein the trim portion has a small ledge along with the small ledge of the U-shaped shelf that prevents liquids from spilling off the U-shaped shelf and the removable shelf within the U-shaped shelf.

9. The U-shaped shelf for a refrigerator cabinet of claim 2 further comprising interchangeable insert shelves configured to replace the center shelf or be located between a removable shelf and an end of the U-shaped shelf that is facing a user of the refrigerator.

10. The U-shaped shelf for a refrigerator cabinet of claim 2, wherein the U-shape of the U-shaped shelf is off-center so that one of the right side portion or the left side portion is wider that the other of the right side portion and the left side portion.

11. The U-shaped shelf for a refrigerator cabinet of claim 10, wherein the tuck shelf is offset from a center of the U-shaped shelf to correspond to the off-center arrangement of the U-shape.

* * * * *